US008857811B2

(12) United States Patent
Kakuta et al.

(10) Patent No.: US 8,857,811 B2
(45) Date of Patent: Oct. 14, 2014

(54) SHEET TRANSPORT DEVICE AND IMAGE FORMING APPARATUS INCORPORATED WITH THE SAME

(71) Applicant: KYOCERA Document Soultions Inc., Osaka (JP)

(72) Inventors: Masayuki Kakuta, Osaka (JP); Hironori Daigo, Osaka (JP); Hiroaki Takai, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 13/650,857

(22) Filed: Oct. 12, 2012

(65) Prior Publication Data

US 2013/0193631 A1 Aug. 1, 2013

(30) Foreign Application Priority Data

Oct. 17, 2011 (JP) ..... 2011-227866

(51) Int. Cl.

| | |
|---|---|
| ***B65H 3/52*** | (2006.01) |
| ***B65H 5/06*** | (2006.01) |
| ***B65H 1/00*** | (2006.01) |
| ***B65H 1/26*** | (2006.01) |
| ***B65H 3/06*** | (2006.01) |

(52) U.S. Cl.

CPC ..... *B65H 1/00* (2013.01); *B65H 5/062* (2013.01); *B65H 1/266* (2013.01); *B65H 2404/143* (2013.01); *B65H 2402/10* (2013.01); *B65H 2404/611* (2013.01); *B65H 3/0684* (2013.01)

USPC ..... 271/121; 271/164

(58) Field of Classification Search

CPC ..... B65H 3/0684; B65H 3/56; B65H 1/266
USPC ..... 271/117, 118, 121, 122, 164
See application file for complete search history.

(56) References Cited

U.S. PATENT DOCUMENTS

| | | | | |
|---|---|---|---|---|
| 7,571,905 | B2 * | 8/2009 | Kim | 271/117 |
| 2004/0071486 | A1 * | 4/2004 | Manabe et al. | 399/367 |
| 2005/0179192 | A1 * | 8/2005 | Miura et al. | 271/118 |

FOREIGN PATENT DOCUMENTS

| | | |
|---|---|---|
| JP | 2004-210468 | 7/2004 |

* cited by examiner

*Primary Examiner* — Michael McCullough
(74) *Attorney, Agent, or Firm* — Gerald E. Hespos; Michael J. Porco; Matthew T. Hespos

(57) ABSTRACT

A sheet transport device has a housing member, a sheet tray, a transport path, a dispensing portion, a feeding portion, and a projecting member. Sheets are accommodated in the sheet tray. The sheet tray is detachably attached to the housing member, and is configured to be pulled out of the housing member in a first direction. The transport path is disposed in the housing member, and extends from the sheet tray in a second direction perpendicular to the first direction. The dispensing portion dispenses the sheets to the transport path. The feeding portion is rotated in contact with the sheet for feeding the sheet toward downstream of the transport path. The projecting member is configured to be projected and retracted with respect to the transport path near the imaginary line extending from a sheet nip portion in the first direction.

16 Claims, 21 Drawing Sheets

SHEET TRANSPORT DEVICE AND IMAGE FORMING APPARATUS INCORPORATED WITH THE SAME

This application is based on and claims the benefit of priority from Japanese Patent Application No. 2011-227866 filed on Oct. 17, 2011, the contents of which are hereby incorporated by reference.

BACKGROUND

The present disclosure relates to a sheet transport device for transporting sheets, for suitably use in an image forming apparatus such as a copier or a printer.

A sheet transport device having a tray for accommodating a number of sheets, and adapted to transport the sheets from the tray is incorporated in an image forming apparatus such as a copier, a printer, a facsimile machine, or a complex machine having the functions of these devices. In the image forming apparatus, the sheet transport device is provided with a sheet storing portion for storing sheets. The sheets stored in the sheet storing portion are dispensed one by one from the sheet storing portion and transported for forming an image on each of the sheets in a main body of the image forming apparatus.

In the thus constructed sheet transport device, the sheet storing portion has a cassette structure which is configured to be detachably attachable to the apparatus main body. The sheet storing portion has a guide member for restricting displacement of a sheet in a sheet width direction for stabilizing sheet transport. The guide member is movable in the sheet width direction. With this arrangement, the position of the guide member is adjusted for transporting various types of sheets.

In a conventional sheet transport device, as shown in a top plan view of FIG. 19, a sheet is disposed at the sheet position P1 in a sheet tray 500 as a sheet storing portion in a state that the position of the sheet in the sheet width direction is restricted by guide members 520. A pickup roller 310 is contacted with a right end of the sheet for feeding the sheet toward a sheet transport path. Further, a sheet feeding roller 320 for separating the sheet from other sheets, and a transport roller 330 for transporting the sheet separated from the other sheets by the sheet feeding roller 320 further toward the sheet transport path are disposed on the right side (downstream side in the sheet transport direction) of the pickup roller 310. When an image forming operation is being carried out in the image forming apparatus, transport of the sheet fed out from the sheet tray 500 may be stopped by e.g. a sheet jam in a state that a leading end of the sheet is stuck in the vicinity of a sheet feeding nip portion A formed by the sheet feeding roller 320. In the case where a user tries to pull out the sheet tray 500 in the arrow D1A direction in the above condition, the sheet at the sheet position P1 may be pushed in the arrow D1A direction by the guide members 520, and at the same time, may receive a pivotal force as indicated by the arrow R1 direction, because the sheet is nipped near the sheet feeding nip portion A. By application of the pivotal force, the sheet may be pushed and displaced to the sheet position P2, and may hit against a post frame 231 of the apparatus body. As a result, a part of the sheet may be left in the image forming apparatus while forming creases in the sheet, without being pulled out together with the sheet tray 500. In a worse case, the sheet may be damaged or torn.

In view of the above, an object of the present disclosure is to provide an arrangement capable of preventing a likelihood that a sheet may be stuck between a sheet tray and an apparatus main body, and may be damaged or torn, with a part of the sheet being left in the apparatus main body, even if a sheet tray is pulled out of the apparatus main body in a state that a leading end of the sheet has been fed out in a sheet transport path from the sheet tray.

SUMMARY

A sheet transport device according to an aspect of the present disclosure includes a housing member, a sheet tray, a sheet transport path, a sheet dispensing portion, a sheet feeding portion, a sheet separating portion, and a projecting member. A number of sheets are accommodated in the sheet tray. The sheet tray is detachably attached to the housing member and configured to be pulled out of the housing member in a first direction. The sheet transport path is formed in the housing member, and extends from the sheet tray in a second direction intersecting with the first direction. The sheet dispensing portion is disposed to face the sheets accommodated in the sheet tray, and dispenses the sheets one by one to the sheet transport path. The sheet feeding portion is rotated in contact with the sheet dispensed from the sheet dispensing portion, and feeds the sheet toward downstream of the sheet transport path. The sheet separating portion is disposed to face the sheet feeding portion, and separates the sheet to be fed from the other sheets. The projecting member is configured to be projected and retracted with respect to the sheet transport path at a position near an imaginary line extending from a sheet nip portion in the first direction. The sheet nip portion is formed by the sheet feeding portion and the sheet separating portion.

An image forming apparatus according to another aspect of the present disclosure includes the sheet transport device having the above arrangement, and an image forming assembly. The image forming assembly is configured to form an image on the sheet transported by the sheet transport device.

These and other objects, features and advantages of the present disclosure will become more apparent upon reading the following detailed description along with the accompanying drawings.

DETAILED DESCRIPTION

Figure 1:
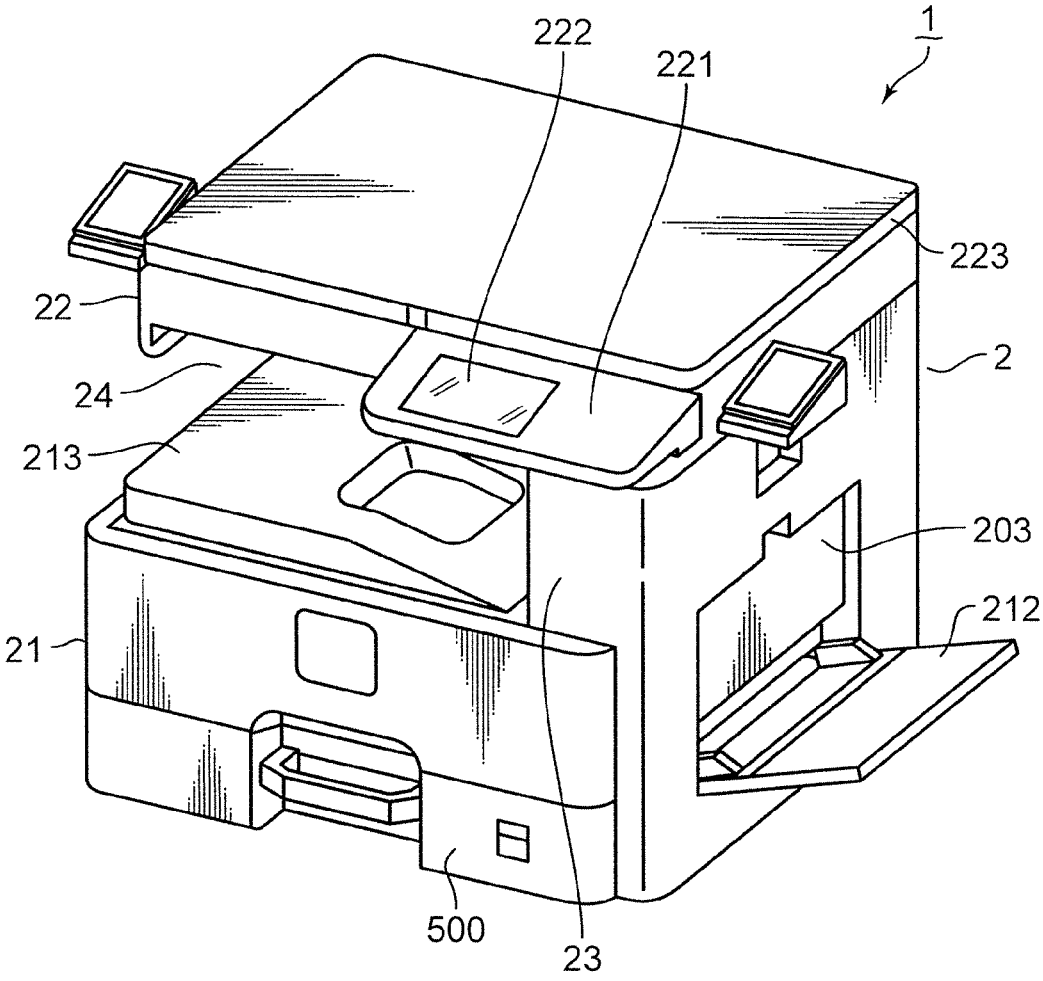
FIG. 1 is a perspective view of an image forming apparatus embodying the present disclosure.

In the following, embodiments of the present disclosure are described referring to the drawings. In the following description, the term "sheet" means a copy sheet, coated paper, an OHP sheet, thick paper, a post card, tracing paper, or other sheet member which is subjected to an image forming processing; or a sheet member which is subjected to a processing other than the image forming processing. Further, the term "first direction downstream side" means the side corresponding to the tip end of the arrow D1A in the drawings, wherein the arrow D1A direction corresponds to a first direction. Likewise, the term "first direction upstream side" means the side corresponding to the base end of the arrow D1A.

Figure 2:
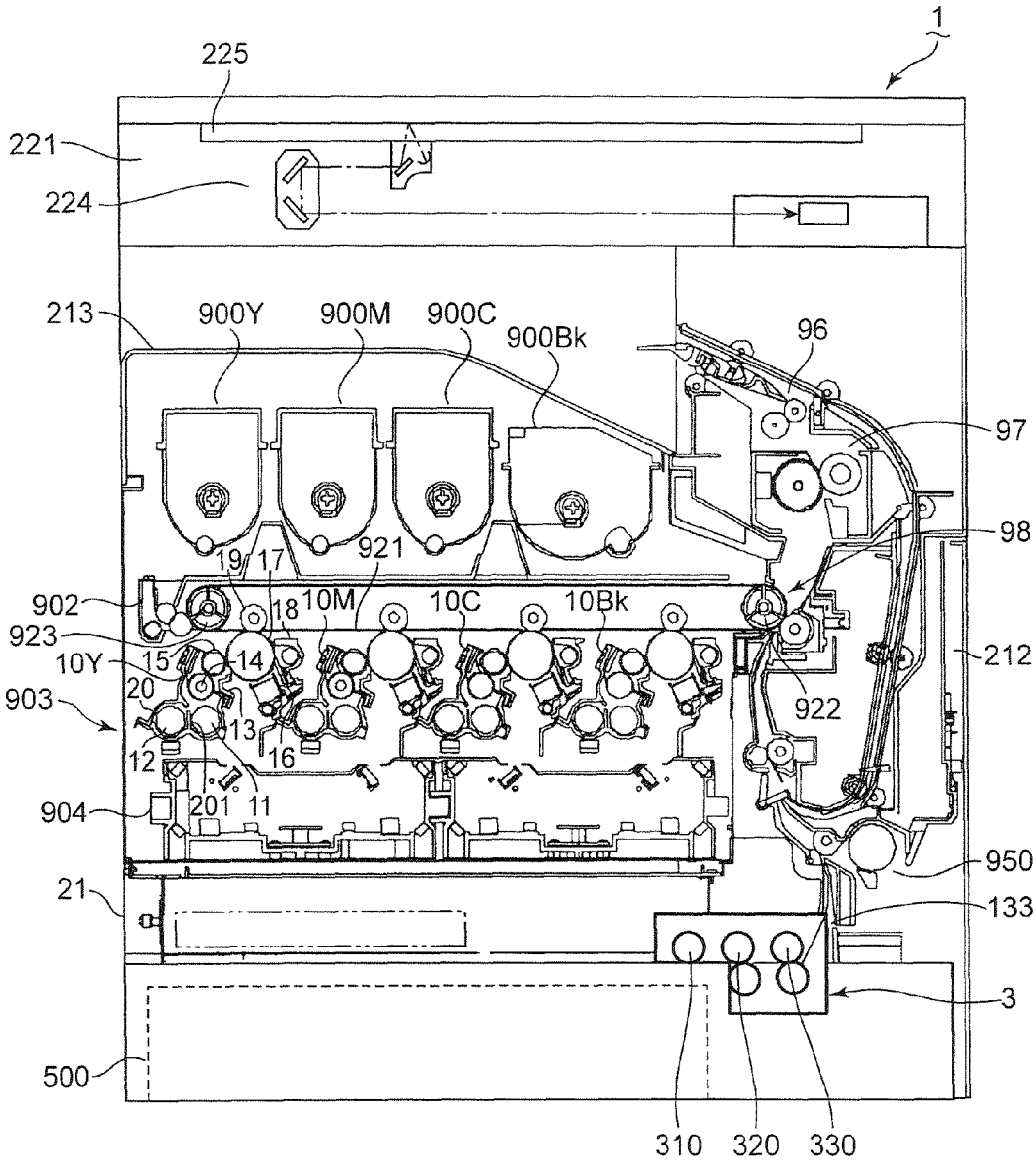
FIG. 2 is a cross-sectional view showing an internal structure of the image forming apparatus embodying the present disclosure.

FIG. 1 is a perspective view of an image forming apparatus embodying the present disclosure. FIG. 2 is a diagram schematically showing an internal structure of the image forming apparatus shown in FIG. 1. The image forming apparatus shown in FIG. 1 and FIG. 2 is a copier having an internal discharge tray. Alternatively, the image forming apparatus may be a printer, a facsimile machine, a complex machine having the functions of these devices, or any other apparatus for forming a toner image on a sheet.

The image forming apparatus 1 includes a substantially rectangular parallelepiped-shaped main housing portion 2. The main housing portion 2 includes a substantially rectangular parallelepiped-shaped lower housing portion 21 (housing member), a substantially rectangular parallelepiped-shaped upper housing portion 22 which is disposed above the lower housing portion 21, and a connection housing portion 23 for connecting between the lower housing portion 21 and the upper housing portion 22. The connection housing portion 23 extends along a right perimeter and a rear perimeter of the main housing portion 2. A sheet subjected to printing is discharged to a discharge space 24 surrounded by the lower housing portion 21, the upper housing portion 22, and the connection housing portion 23.

An operation portion 221 projecting in a front direction of the upper housing portion 22 includes e.g. an LCD touch panel 222. The operation portion 221 is configured in such a manner that a user is allowed to input information relating to an image forming processing. The user is allowed to input e.g. the number of sheets to be printed or a printing density through the LCD touch panel 222. A device for reading a document image and an electronic circuit for controlling overall operations of the image forming apparatus 1 are mainly housed in the upper housing portion 22.

A pressing cover 223 disposed above the upper housing portion 22 is used for pressing a document. The pressing cover 223 is mounted on the upper housing portion 22 to be pivotally movable in up and down directions. The user is allowed to pivotally move the pressing cover 223 upwardly, and to place a document on the upper housing portion 22. Thereafter, the user is allowed to cause the device disposed in the upper housing portion 22 to read an image of the document by manipulating the operation portion 221.

A sheet tray 500 for accommodating a number of sheets is disposed in the lower housing portion 21 (housing member). The sheet tray 500 is detachable from the lower housing portion 21 in a front direction (first direction). The sheets accommodated in the sheet tray 500 are successively fed upwardly in the lower housing portion 21, subjected to an image forming processing in the lower housing portion 21, based on an instruction inputted by the user through the operation portion 221, and discharged to the discharge space 24.

Further, a manual tray 212 is mounted on a right surface of the lower housing portion 21 to be pivotally movable. As shown in FIG. 1, when the manual tray 212 is set to such a position as to project rightwardly from the lower housing portion 21, the user is allowed to place a sheet or sheets on the manual tray 212. After a sheet placed on the manual tray 212 is fed into the lower housing portion 21, based on an instruction inputted by the user through the operation portion 221, the sheet is subjected to an image forming processing, and discharged to the discharge space 24. When the manual tray 212 is pivotally moved upwardly, the manual tray 212 is housed in a housing space 203 formed in the right surface of the lower housing portion 21, whereby a sheet supply port for feeding a sheet into the lower housing portion 21 is closed.

The lower housing portion 21 houses therein various devices for forming an image on a sheet. Further, the connection housing portion 23 houses therein various devices for discharging a sheet subjected to an image forming processing to the discharge space 24.

The upper housing portion 22 houses therein a scanning mechanism 224. The user is allowed to cause the image forming apparatus 1 to read an image of an intended document by the scanning mechanism 224. A contact glass 225 to be mounted on a top surface of the upper housing portion 22 is disposed above the scanning mechanism 224. The pressing cover 223 (see FIG. 1) is used to press a document placed on the contact glass 225. When the user operates the image forming apparatus 1 through the operation portion 221, the scanning mechanism 224 scans an image of the document placed on the contact glass 225 for reading the image. Analog information of the image read by the scanning mechanism 224 is converted into a digital signal. The image forming apparatus 1 forms an image on a sheet based on the digital signal.

The lower housing portion 21 houses therein an intermediate transfer unit 902, an image forming assembly 903, an exposure unit 904, a fixing unit 97, a discharge unit 96, and a sheet transport unit 3.

The image forming assembly 903 includes a yellow toner container 900Y, a magenta toner container 900M, a cyan toner container 900C, and a black toner container 900Bk. Developing devices 10Y, 10M, 10C and 10Bk respectively corresponding to the colors of yellow (Y), magenta (M), cyan (C) and black (Bk) are disposed below the respective corresponding containers 900Y, 900M, 900C, and 900Bk.

The image forming assembly 903 includes photosensitive drums 17 for carrying toner images of the respective colors. An example of the photosensitive drum 17 is a photosensitive drum using an amorphous silicon (a-Si)-based material. Yellow toner, magenta toner, cyan toner, and black toner are respectively supplied from a developing unit 10 (developing devices 10Y, 10M, 10C, and 10Bk) to the respective corresponding photosensitive drums 17.

A charger 16, the developing unit 10 (developing device 10Y, 10M, 10C, 10Bk), a transfer roller 19, and a cleaning device 18 are disposed around each of the photosensitive drums 17. The charger 16 uniformly charges the surface of the corresponding photosensitive drum 17. The surface of the photosensitive drum 17 after the charging is exposed to light by the exposure unit 904 for forming an electrostatic latent image on the surface of the photosensitive drum 17. The exposure unit 904 irradiates the circumferential surface of each of the photosensitive drums 17 with laser light, based on a digital signal generated by the scanning mechanism 224 as described above. The developing devices 10Y, 10M, 10C, and 10Bk respectively develop the electrostatic latent images formed on the photosensitive drums 17 into toner images of the respective colors, using the color toners to be supplied from the toner containers 900Y, 900M, 900C, and 900Bk. The transfer roller 19 forms a nip portion with the corresponding photosensitive drum 17 in a state that an intermediate transfer belt 921 is interposed between the photosensitive drum 17 and the transfer roller 19; and transfers the toner image formed on the photosensitive drum 17 onto the intermediate transfer belt 921 (primary transfer). The cleaning device 18 cleans the circumferential surface of the photosensitive drum 17 after the toner image transfer.

Each of the developing devices 10Y, 10M, 10C, and 10Bk is provided with a developing housing member 20. A two-component developer composed of magnetic carrier and toner is accommodated in the developing housing member 20. Further, agitation rollers and 12 are rotatably disposed side by side in the developing housing member 20 at a position near a bottom portion of the developing housing member 20 in a state that an axial direction of the agitation rollers 11 and 12 is aligned with the longitudinal direction of the developing housing member 20.

A circulation path for the developer is formed in an inner bottom surface of the developing housing member 20. The agitation rollers 11 and 12 are disposed in the circulation path. A partition wall 201 standing upright from the bottom portion of the developing housing member 20 extends in the axial direction of the agitation rollers 11 and 12 at a position between the agitation rollers 11 and 12. The partition wall 201 divides the circulation path. The circulation path is formed in such a manner as to circulate around the partition wall 201. The two-component developer is charged, while being agitated and transported along the circulation path by the agitation rollers 11 and 12.

When the two-component developer is circulated in the developing housing member 20, the toner is charged. The two-component developer on the agitation roller 11 is carried while being magnetically attracted by a magnetic roller 14 disposed above the agitation roller 11. The magnetically attracted two-component developer forms a magnetic brush (not shown) on the magnetic roller 14. The magnetic brush has its layer thickness restricted by a doctor blade 13. Toner contained in the magnetic brush whose layer thickness is restricted is further supplied from the magnetic roller 14 to a developing roller 15 disposed above the magnetic roller 14. When the toner is supplied, a toner layer is formed on the developing roller 15 by a potential difference between the magnetic roller 14 and the developing roller 15. An electrostatic latent image on the photosensitive drum 17 is developed into a toner image by the toner layer.

The exposure unit 904 has various optical devices such as a light source, a polygon mirror, a reflection mirror, and a deflection mirror. The exposure unit 904 irradiates light based on image data onto the circumferential surface of each of the photosensitive drums 17 which are disposed at respective appropriate positions in the image forming assembly 903 for forming electrostatic latent images.

The intermediate transfer unit 902 is provided with the intermediate transfer belt 921, a driving roller 922, and a driven roller 923. Toner images are formed one over the other from the respective corresponding photosensitive drums 17 onto the intermediate transfer belt 921 (primary transfer). The superimposed toner images formed by the primary transfer are transferred onto a sheet supplied from the sheet tray 500 or from the manual tray 212 (see FIG. 1) in a secondary transfer portion (secondary transfer). The driving roller 922 and the driven roller 923 for driving and circulating the intermediate transfer belt 921 are rotatably supported by the lower housing portion 21.

The fixing unit 97 applies a fixing processing to the toner images on the sheet transferred by the intermediate transfer unit 902 by the secondary transfer. The sheet carrying a color image after the fixing processing is discharged toward the discharge unit 96 which is disposed above (within the connection housing portion 23) the fixing unit 97.

The discharge unit 96 discharges the sheet transported from the fixing unit 97 to a top surface 213 of the lower housing portion 21 as a discharge tray.

<Structure of Sheet Tray>

Figure 3:
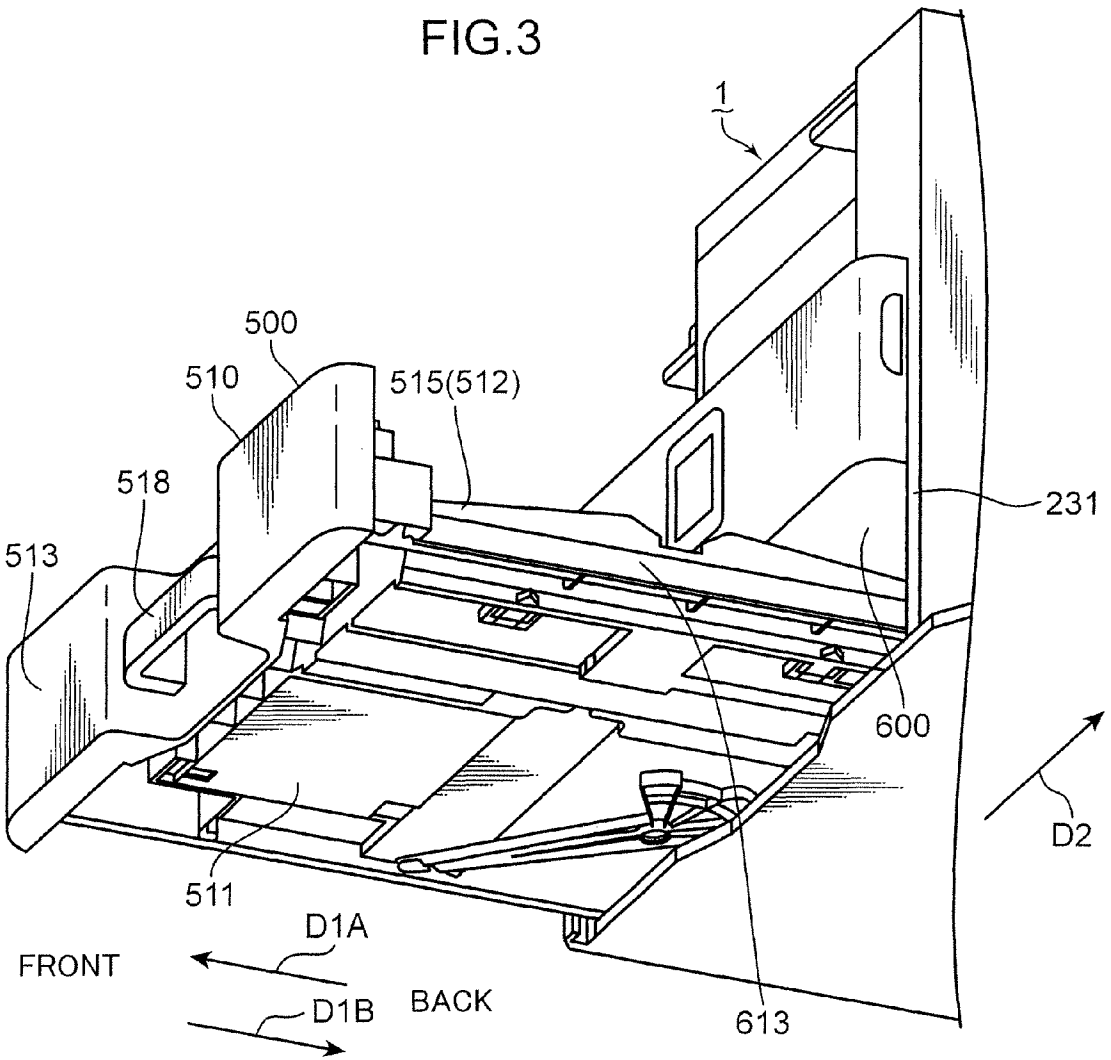
FIG. 3 is a perspective view of a sheet tray which is about to be pushed into or pulled out of the image forming apparatus embodying the present disclosure.

FIG. 3 is a perspective view of the sheet tray 500 which is about to be pushed into a housing space 600 formed in the lower housing portion 21, or about to be pulled out of the housing space 600.

The sheet tray 500 is configured to be housable in the housing space 600. In the case where the user replenishes sheets into the sheet tray 500, or in the case where the user replaces a stack of sheets in the sheet tray 500 with another stack of sheets, the user pulls the sheet tray 500 out of the housing space 600. Further, in the case where the user replenishes sheets into the sheet tray 500, or after the user replaces a stack of sheets in the sheet tray 500 with another stack of sheets, the user pushes the sheet tray 500 into the housing space 600. When the sheet tray 500 is housed in the housing space 600, the sheet tray 500 holds the sheets within the lower housing portion 21. Movement of the sheet tray 500 in and out of the housing space 600 are guided by rails 613. In the following description, to simplify the description, a direction (a direction from back side to front side) in which the sheet tray 500 is pulled out of the housing space 600 is called as a first direction (the arrow D1A direction in the drawings), and a direction (a direction from front side to back side) in which the sheet tray 500 is pushed into the housing space 600 is called as a counter first direction (the arrow D1B direction in the drawings).

Figure 4:
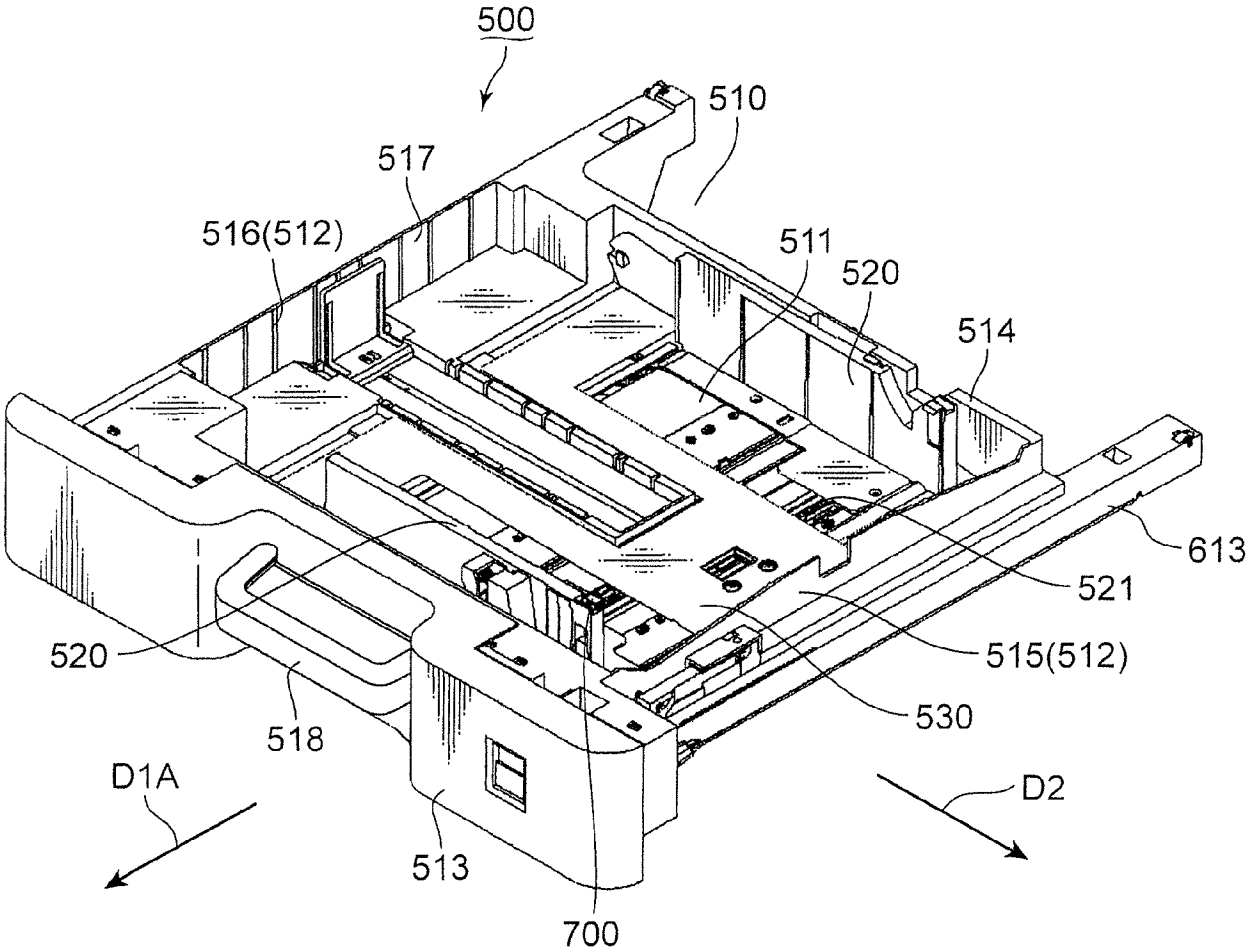
FIG. 4 is a perspective view of the sheet tray when viewed from above.

FIG. 4 is a perspective view of the sheet tray 500. The sheet tray 500 includes a sheet tray housing member 510 which is configured to house sheets therein. The sheet tray housing member 510 includes a substantially rectangular bottom wall 511, a lift plate 530 placed over the bottom wall 511, a pair of side walls 512 standing upright from a perimeter of the bottom wall 511, a front wall 513, and a back wall 514. The front wall 513 extending between front side perimeters of the paired side walls 512 appears on the outer side of the main housing portion 2 when the sheet tray housing member 510 is completely housed in the housing space 600. The back wall 514 is disposed to face the front wall 513. One of the paired side walls 512 which is located on the right side serves as a downstream wall 515 positioned downstream in the sheet transport direction, and the other of the paired side walls 512 which is located on the left side serves as an upstream wall 516 positioned upstream in the sheet transport direction. Respective engagements of the paired side walls 512 and the rails 613 guide movement of the sheet tray 500 in the first direction and in the counter first direction. The front wall 513 is provided with a substantially U-shaped holding member 518. The user is allowed to hold the holding member 518 and to move the sheet tray 500 in the first direction and in the counter first direction. Upper perimeters of the paired side walls 512, the front wall 513, and the back wall 514 define an opening 517 for accommodating the sheets in the sheet tray 500. The user is allowed to accommodate the sheets in the sheet tray housing member 510 through the opening 517.

The sheet tray 500 further includes a pair of guide members 520 respectively adjacent to the front wall 513 and to the back wall 514. The guide members 520 restrict displacement of a sheet placed on the lift plate 530 in the sheet width direction. The bottom wall 511 is formed with guide grooves 521 along which movement of the guide members 520 is guided. The guide grooves 521 extend from the front wall 513 toward the back wall 514. With this arrangement the guide members 520 are movable in the sheet width direction. Thus, the user is allowed to bring lateral ends of a sheet of any size into contact with the guide members 520.

The lift plate 530 is disposed above the bottom wall 511, and sheets are stacked on a top surface of the lift plate 530. Referring to FIG. 4, a downstream end portion (downstream wall 515 side) of the lift plate 530 in the sheet transport direction is lifted up in a state that sheets are stacked on the top surface of the lift plate 530, whereby the stacked sheets are ready to be fed out one by one toward the sheet transport unit 3.

<Structure of Sheet Transport Unit>

Figure 5:
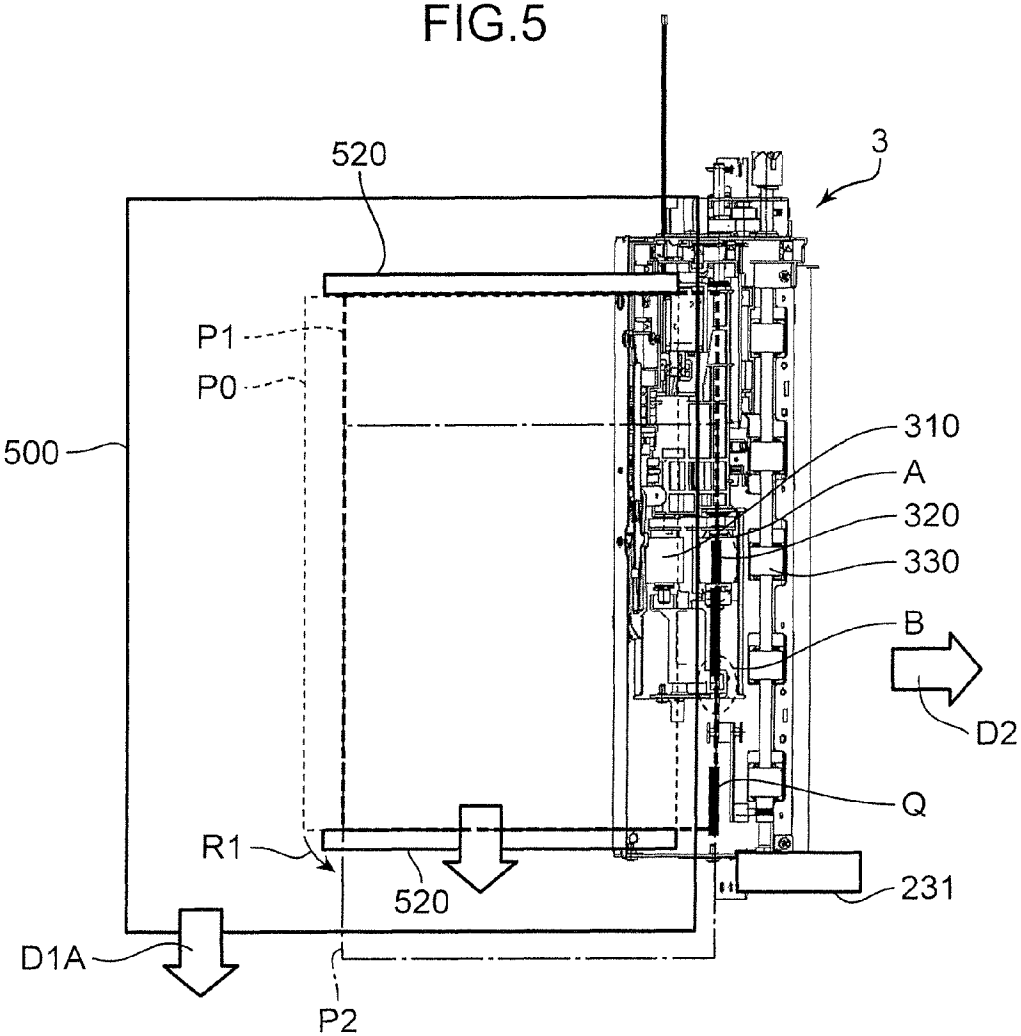
FIG. 5 is a top plan view of a sheet transport unit in a first embodiment of the present disclosure.
Figure 6:
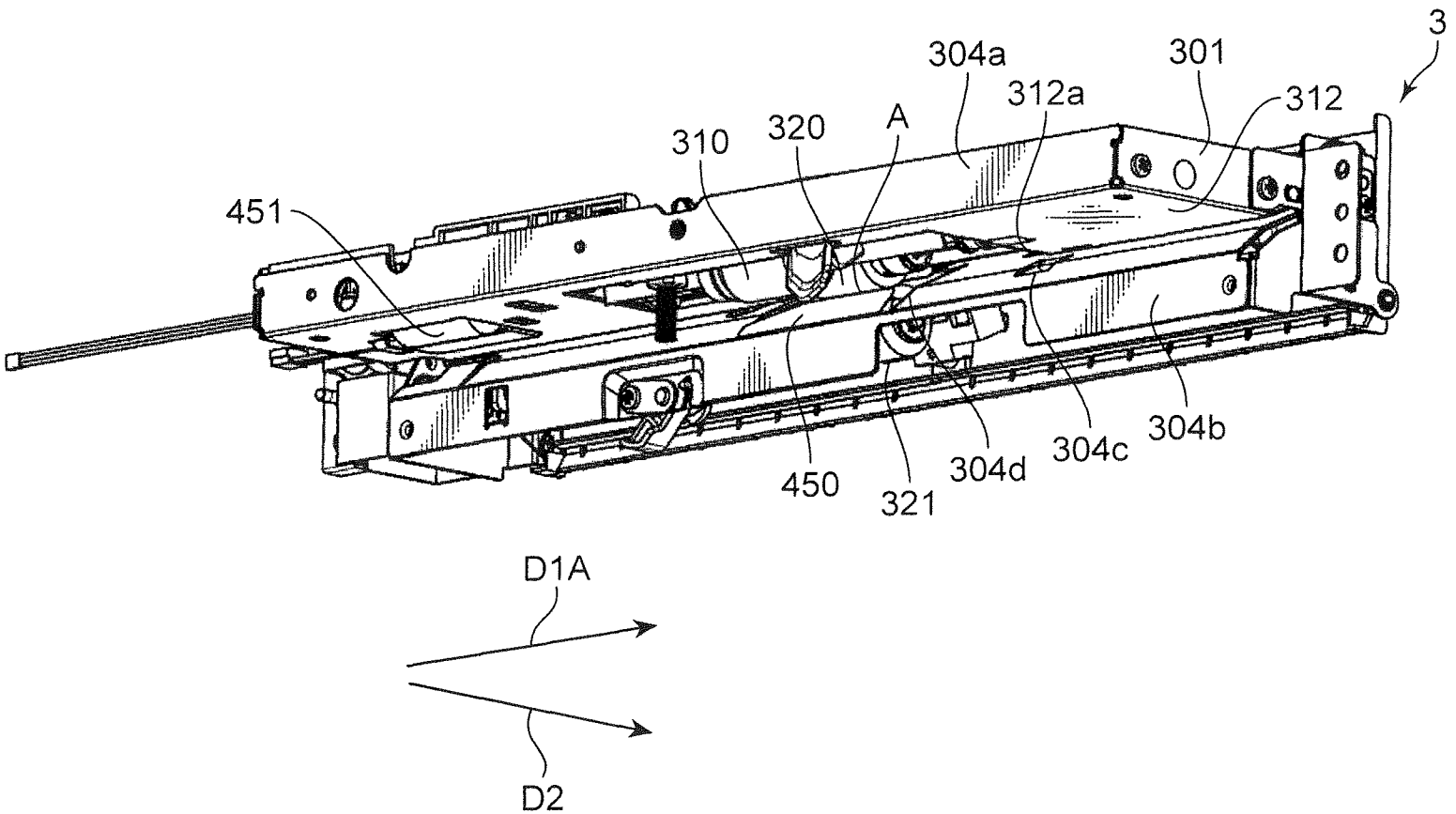
FIG. 6 is a perspective view of the sheet transport unit in the first embodiment of the present disclosure.
Figure 7:
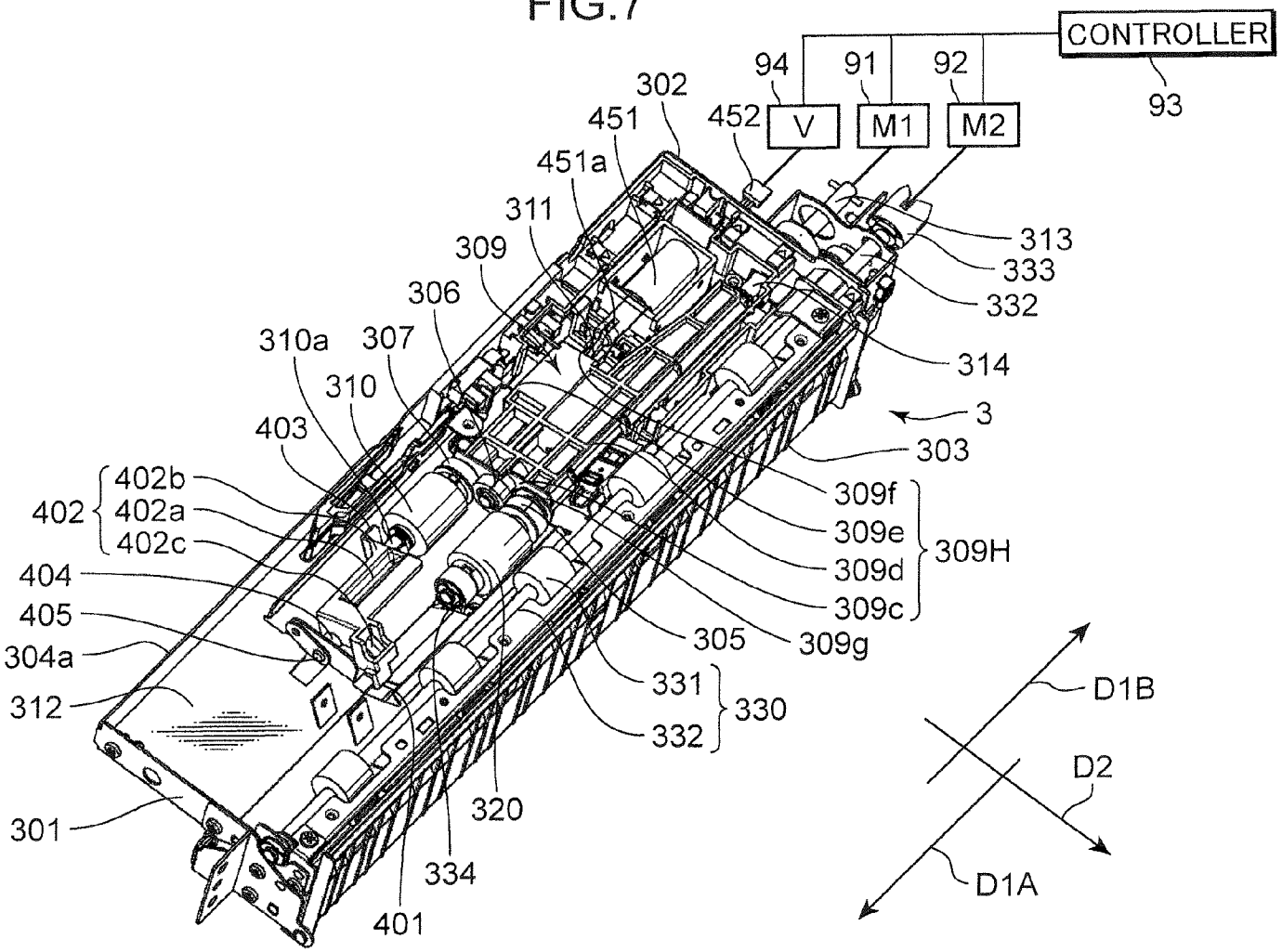
FIG. 7 is a perspective view of the sheet transport unit in the first embodiment of the present disclosure.
Figure 8:
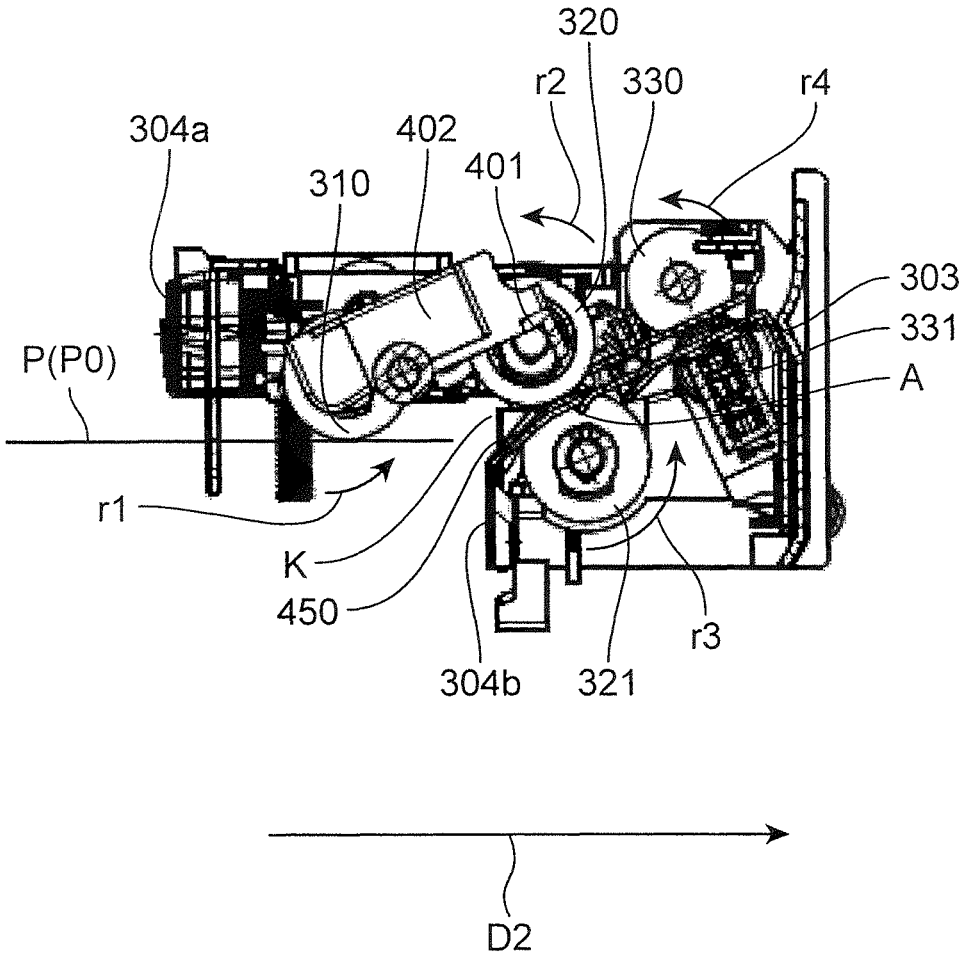
FIG. 8 is a cross-sectional view of the sheet transport unit in the first embodiment of the present disclosure.
Figure 9:
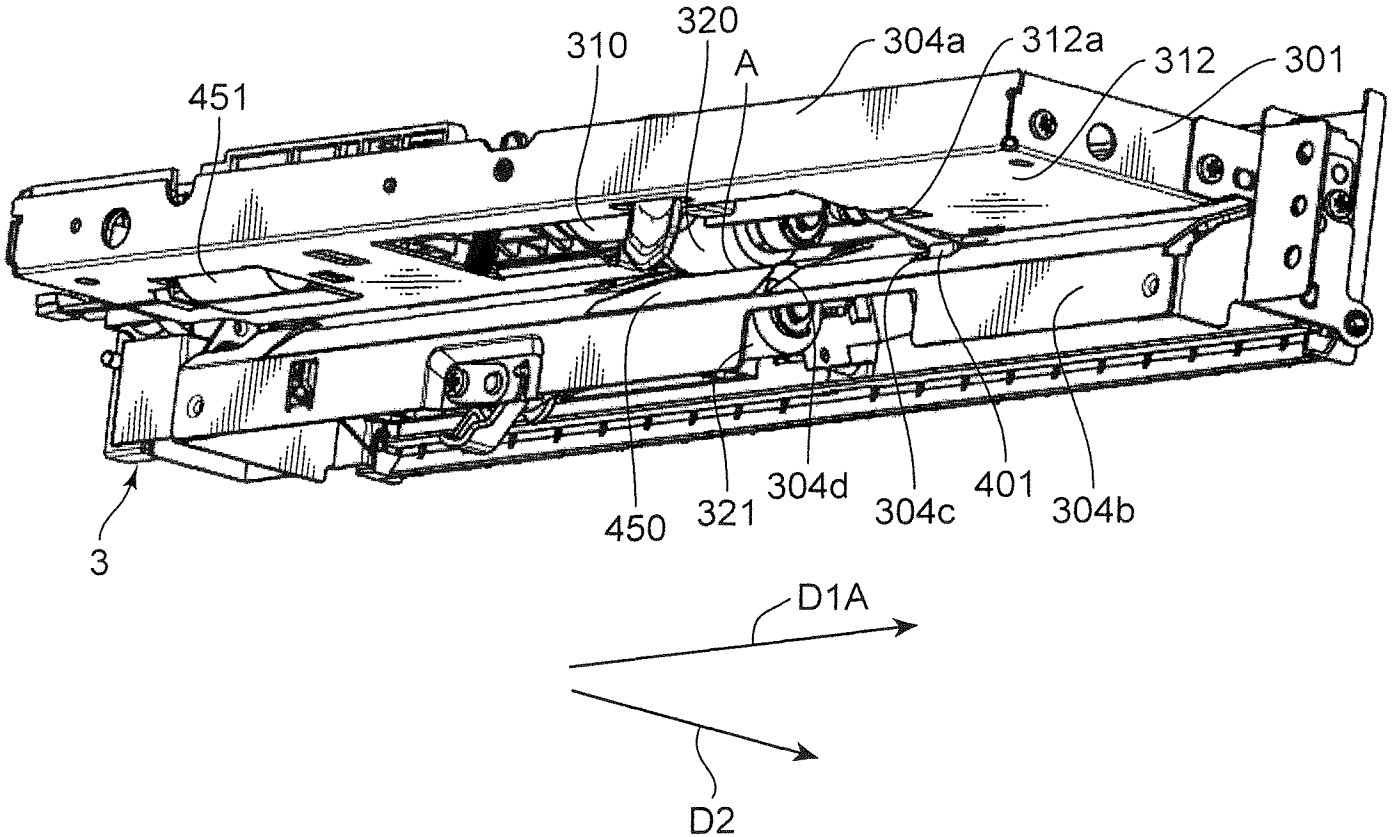
FIG. 9 is a perspective view of the sheet transport unit in the first embodiment of the present disclosure.
Figure 10:
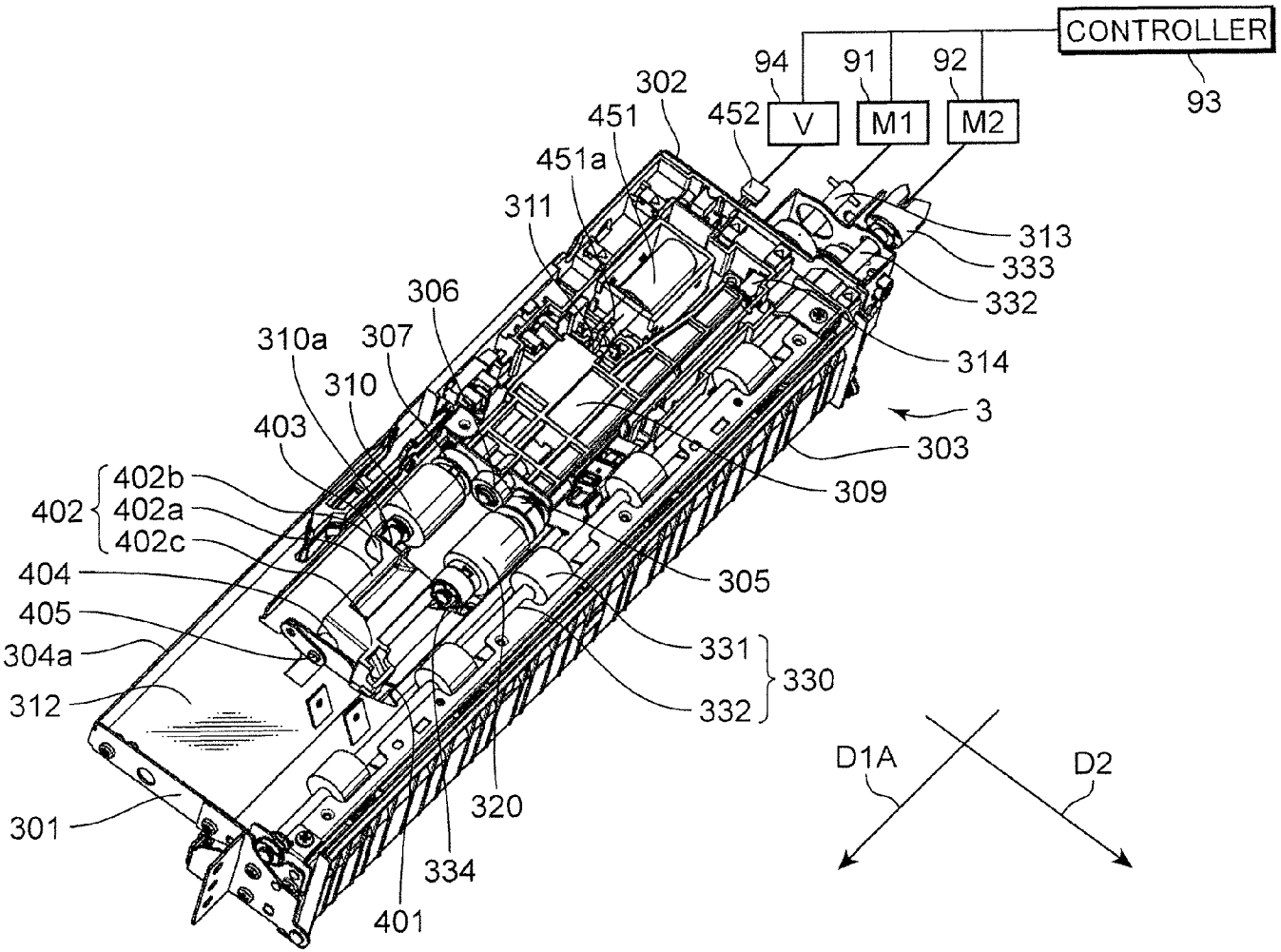
FIG. 10 is a perspective view of the sheet transport unit in the first embodiment of the present disclosure.
Figure 11:
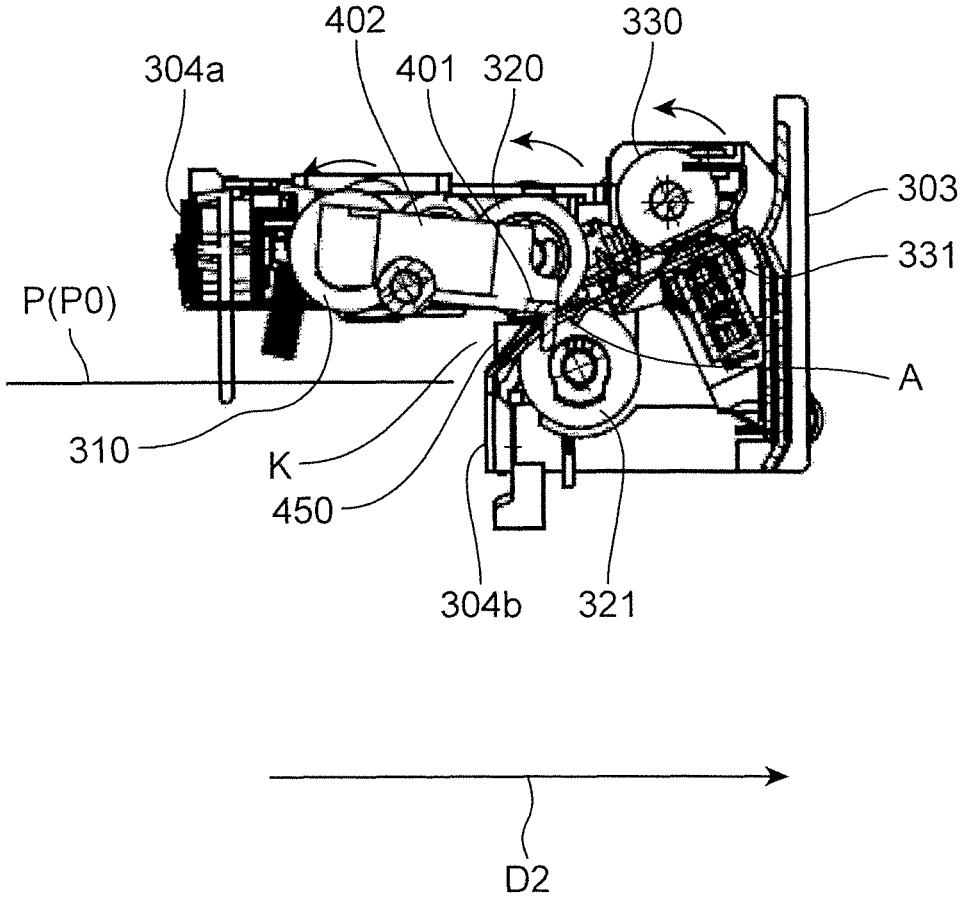
FIG. 11 is a cross-sectional view of the sheet transport unit in the first embodiment of the present disclosure.

In this section, the sheet transport unit 3 (sheet transport device) in the first embodiment of the present disclosure is described referring to FIGS. 5 through 11. FIG. 5 is a top plan view of the sheet transport unit 3 in this embodiment. FIG. 6 and FIG. 7 are respectively perspective views of the sheet transport unit 3, and FIG. 8 is a cross-sectional view of the sheet transport unit 3. FIGS. 6 through 8 show that a stopper 401 to be described later is retracted from a sheet transport path 133. Likewise, FIG. 9 and FIG. 10 are perspective views of the sheet transport unit 3, and FIG. 11 is a cross-sectional view of the sheet transport unit 3. FIGS. 9 through 11 show that the stopper 401 to be described later is projected into the sheet transport path 133.

The sheet transport unit 3 is disposed above the sheet tray 500 in the lower housing portion 21 shown in FIG. 2. The sheet transport unit 3 separates a stack of sheets lifted up by the lift plate 530 (see FIG. 4) in the sheet tray 500 one by one, and transports an uppermost sheet (hereinafter, called as an "uppermost sheet P" or a "sheet P") of the sheet stack toward downstream of the sheet transport path 133. The sheet transport path 133 extends in a second direction (the arrow D2 direction in the drawings) perpendicularly intersecting with the first direction. Since the sheet transport unit 3 is fixedly disposed in the lower housing portion 21 as described above, there is no likelihood that the sheet transport unit 3 may be pulled out of the lower housing portion 21, even if the user moves the sheet tray 500 in and out of the lower housing portion 21 in the first direction or in the counter first direction.

As shown in FIG. 6 and FIG. 7, the sheet transport unit 3 is a box-shaped unit having an L-shape in section. The outer configuration of the sheet transport unit 3 is formed by a pair of substantially L-shaped side walls 301 and 302 which form longitudinal side surfaces; a front wall 303 (see FIG. 7) which connects between the side walls 301 and 302, and forms a front surface of the sheet transport unit 3 in the second direction; a first rear wall 304*a* which forms a rear surface of the sheet transport unit 3 in the second direction; a second rear wall 304*b* which forms a rear surface of an L-shaped bend portion; and an upper surface portion 312 which is constituted of a substantially horizontal plane extending from the first rear wall 304*a* toward the second rear wall 304*b*. The sheets accommodated in the sheet tray 500 are successively transported toward an L-shaped bend portion K (see FIG. 8) formed by the upper surface portion 312 and the second rear wall 304*b*.

The sheet transport unit 3 is provided with a pickup roller 310 (sheet dispensing portion), a sheet feeding roller 320 (sheet feeding portion), a support shaft 314, a separation roller 321 (sheet separating portion), a transport roller 330, an electrical actuator 451 (moving portion), and a swing plate 309 (moving portion). The sheet transport unit 3 is further provided with a first motor 91 and a second motor 92 for use in inputting a rotation driving force to each of the rollers; a controller 93 (controller) for controlling the first motor 91, the second motor 92, and the actuator 451; a power source 94 for supplying an electric current to the actuator 451; a first coupling 313 and a second coupling 333 for transmitting a rotation driving force.

The pickup roller 310 is supported by a middle portion of the upper surface portion 312 in the sheet width direction (first direction) to be rotatable about an axis of a rotary shaft 310*a* which projects from the swing plate 309 to be described later. The pickup roller 310 is located above a front end of the sheet P in a state (see the sheet position P0 shown in FIG. 5) that the sheet stack is accommodated in the sheet tray 500. The pickup roller 310 feeds the sheet stack one by one toward the sheet transport path 133 by being driven and rotated in the entrance of the sheet transport path 133. The pickup roller 310 is pivotally moved between a sheet feeding position (first position, see FIG. 8) where the pickup roller 310 is contacted with an uppermost sheet P of the sheet stack accommodated in the sheet tray 500, and a non-sheet feeding position (second position, see FIG. 11) where the pickup roller 310 is disposed above the uppermost sheet P.

The sheet feeding roller 320 is supported by a middle portion of the upper surface portion 312 in the sheet width direction to be rotatable about an axis of the support shaft 314 as a rotary shaft. The sheet feeding roller 320 is disposed downstream of the pickup roller 310 away from the pickup roller 310 by a predetermined distance in the sheet transport direction (second direction). The sheet feeding roller 320 feeds only the uppermost sheet P of the sheets dispensed by the pickup roller 310 toward downstream in the sheet transport direction.

The support shaft 314 is a rotary shaft which rotatably supports the sheet feeding roller 320. A base end (first direction side) of the support shaft 314 is supported by a frame 309*g* which is disposed to face a side surface portion 309*c* of the swing plate 309 to be described later, passes through a first gear 305 and through the sheet feeding roller 320, and supports a support roller 334 which is disposed adjacent to the sheet feeding roller 320. Further, a distal end (counter first direction side) of the support shaft 314 is supported by the side wall 302. The first coupling 313 is disposed at the distal end of the support shaft 314. The support shaft 314 extends between the base end and the distal end thereof in such a manner as to pass through a part of the swing plate 309.

The separation roller 321 is rotatably supported by an unillustrated support portion at a position below the sheet feeding roller 320 in such a manner that the sheet transport path 133 is interposed between the separation roller 321 and the sheet feeding roller 320 (see FIG. 6). A sheet feeding nip portion A for nipping a sheet P is formed between the sheet feeding roller 320 and the separation roller 321. The separation roller 321 is disposed to project upwardly through an opening 304*d* formed in the second rear wall 304*b*. As shown by the arrow r3 in FIG. 8, the separation roller 321 is rotated in a direction opposite to the rotating direction (shown by the arrow r2) of the sheet feeding roller 320 in the sheet feeding nip portion A. In this arrangement, even in the case where a number sheets are dispensed by the pickup roller 310, it is possible to prevent sheets other than the uppermost sheet P from being transported toward downstream in the sheet transport direction, because the separation roller 321 is rotated in the direction opposite to the rotating direction of the sheet feeding roller 320.

A film 450 is disposed at a position immediately upstream of the separation roller 321 in the sheet transport direction. The film 450 guides the sheet P in such a manner that a leading end of the sheet P may not be creased by the separation roller 321 which is rotated in the direction opposite to the rotating direction of the sheet feeding roller 320. A lower end of the film 450 is fixed to the second rear wall 304*b*, and an upper portion of the film 450 as a free end obliquely extends toward the sheet feeding nip portion A (see FIG. 6). In this arrangement, even if a number of sheets are attempted to be fed toward the sheet feeding nip portion A, it is less likely that the sheets and the separation roller 321 are contacted with each other, because the film 450 is interposed between the separation roller 321 and the sheets. Thus, it is possible to suppress creases in the leading ends of the sheets.

The transport roller 330 is disposed along the front wall 303 on the upper surface portion 312. The transport roller 330 is driven and rotated for transporting the sheet P fed by the sheet feeding roller 320 further toward downstream of the sheet transport path 133. The transport roller 330 has a roller shaft 332, and plural roller portions 331 disposed at a predetermined interval along the roller shaft 332. The roller shaft 332 is rotatably supported by the paired side walls 301 and 302 of the sheet transport unit 3. Further, an end of the roller shaft 332 passes through the side wall 302, and the second coupling 333 for transmitting a rotation driving force of the roller shaft 332 is disposed at a distal end of the roller shaft 332. The pickup roller 310, the sheet feeding roller 320, and the transport roller 330 constitute a part of the sheet transport path 133 along which a sheet is transported to the image forming assembly 903.

The actuator 451 is disposed at a corner portion to be formed by the first rear wall 304*a* and the side wall 302 of the upper surface portion 312. The actuator 451 has a transmission shaft 451*a* projecting from the inside of the actuator 451. The actuator 451 performs a projecting/retracting operation of the transmission shaft 451*a* by controlling supply of an electric current of a predetermined level from the power source 94 through a connector 452 disposed on the outside of the side wall 302. The projecting/retracting movement of the transmission shaft 451*a* is transmitted to the swing plate 309, and is converted into a pivotal movement of the pickup roller 310.

The first motor 91 is connected to the first coupling 313. In response to receiving a control signal from the controller 93, the first motor 91 outputs a rotation driving force for rotating the pickup roller 310 and the sheet feeding roller 320. Further, the second motor 92 is connected to the second coupling 333. In response to receiving a control signal from the controller 93, the second motor 92 outputs a rotation driving force for rotating the transport roller 330.

The controller 93 inputs a control signal to the first motor 91, the second motor 92 and the power source 94. In response to receiving the control signal, the rotating operations of the first motor 91 and the second motor 92, and the projecting/retracting operation of the actuator 451 are respectively performed.

The power source 94 is connected to the actuator 451 via the connector 452. The power source 94 supplies a drive current to the actuator 451 in response to receiving a control signal from the controller 93.

The swing plate 309 is disposed between the side wall 302, and the pickup roller 310 and the sheet feeding roller 320. The swing plate 309 pivotally moves the pickup roller up and down in accordance a driving force to be inputted from the actuator 451.

The swing plate 309 has a substantially rectangular plate body 309H having a long size in the first direction and a short size in the second direction, a transmission portion 311, the aforementioned pickup roller 310, a rotary shaft 310*a*, an idler gear 306, and a second gear 307.

The plate body 309H has a front edge portion 309*d*, a side surface portion 309*c*, a rear end portion 309*e*, and a rear side surface portion 309*f*.

The front edge portion 309*d* corresponds to a long side portion of the rectangular plate body 309H. The front edge portion 309*d* is a wall portion which extends in the first direction at second direction downstream side of the plate body 309H.

The side surface portion 309*c* corresponds to a short side portion of the rectangular plate body 309H. The side surface portion 309*c* is a side wall which extends in the second direction and continues to an end of the front edge portion 309*d* at first direction downstream side.

The rear end portion 309*e* is a wall portion which extends in parallel to the front edge portion 309*d* at second direction upstream side of the plate body 309H, with a length shorter than the length of the front edge portion 309*d*. The rear end portion 309*e* continues to an end of the side surface portion 309*c* at second direction upstream side.

On the other hand, a region on the side wall 302 side of the rear end portion 309*e* of the plate body 309H has such a shape that a corner portion of the rectangular plate body 309H is cut away. The rear side surface portion 309*f* is a side wall which faces the side wall 302 in the region corresponding to the cut-away portion. The rear side surface portion 309*f* is disposed in parallel to the side surface portion 309*c*, and continues to an end of the rear end portion 309*e* at first direction upstream side.

Referring to FIG. 7, the swing plate 309 is configured in such a manner that a portion of the swing plate 309 corresponding to the rear side surface portion 309*f* is rotatable (swingable) about the support shaft 314 as a pivot point in a plane orthogonal to the support shaft 314.

The transmission portion 311 has a crank mechanism, and converts a projecting/retracting movement of the transmission shaft 451*a* of the actuator 451 into a vertical pivotal movement of the plate body 309H. The transmission portion 311 is configured to be contactable with the rear side surface portion 309*f*.

The first gear 305 is disposed at second direction downstream side of the side surface portion 309*c* of the plate body 309H. The first gear 305 is rotatably supported by the support shaft 314 which projects from the rear side surface portion 309*c* passing through the plate body 309H from the side wall 302 in the first direction. The first gear 305 is rotated together with the support shaft 314, and transmits the rotation driving force of the support shaft 314 to the idler gear 306.

The idler gear 306 is freely and rotatably supported by an unillustrated shaft portion which projects from a second-direction middle portion of the side surface portion 309*c* in the first direction. The idler gear 306 receives a rotation driving force from the first gear 305, and transmits the rotation driving force to the second gear 307.

The second gear 307 is rotatably supported by the rotary shaft 310*a* which projects from second direction upstream side of the side surface portion 309*c* in the first direction. The second gear 307 receives a rotation driving force from the idler gear 306, and transmits the rotation driving force to the pickup roller 310 which is supported above the rotary shaft 310*a*.

<Driving Transmission within Sheet Transport Unit>

In this section, a driving transmission structure of the sheet transport unit 3 is described in detail, referring to FIG. 7. The first motor 91 and the second motor 92 disposed on the lower housing portion 21 side are controlled by the controller 93, and respectively input rotation driving forces thereof to the first coupling 313 and to the second coupling 333.

The rotation driving force inputted to the first coupling 313 is transmitted to the support shaft 314. By the force transmission, the sheet feeding roller 320 fixedly supported on the base end of the support shaft 314 is driven and rotated. Further, the rotation driving force transmitted to the support shaft 314 is transmitted from the first gear 305 to the second gear 307 via the idler gear 306. Then, the rotation driving force is transmitted from the second gear 307 to the pickup roller 310, whereby the pickup roller 310 is driven and rotated.

On the other hand, the rotation driving force inputted to the second coupling 333 is directly inputted to the roller shaft 332 of the transport roller 330 for rotating the roller portions 331.

Further, the actuator 451 performs a projecting/retracting operation by receiving an electric current from the power source 94 via the connector 452, in response to receiving a control signal from the controller 93.

In the case where an electric current is not supplied to the actuator 451, the transmission shaft 451*a* is projected from a main body of the actuator 451 in the first direction. When the transmission shaft 451*a* is projected, the crank mechanism of the transmission portion 311 is bent, thereby absorbing the projecting movement of the transmission shaft 451*a*. Accordingly, there is no likelihood that an external force for causing vertical pivotal movement of the pickup roller 310 may be exerted on the plate body 309H. Further, since the centroid of the swing plate 309 is disposed on the rear end portion 309*e* side, the swing plate 309 is stopped at a position where the rear end portion 309*e* is pivotally moved downwardly about the axis of the support shaft 314, and stopped thereat. In this case, the pickup roller 310 which is supported by the rotary shaft 310*a* at second direction upstream side of the side surface portion 309*c* is also stopped at a lower position within a vertical movement range of the pickup roller 310. As a result of the above operation, the pickup roller 310 is positioned to the sheet feeding position (first position, see FIG. 8) where the pickup roller 310 is contacted with the uppermost sheet of the sheet stack accommodated in the sheet tray 500.

On the other hand, in the case where an electric current is supplied to the actuator 451, and the projecting/retracing operation of the actuator 451 is performed, the transmission shaft 451*a* is retracted into the main body of the actuator 451 toward first direction upstream side. By the retracting operation, the crank mechanism of the transmission portion 311 interconnected to the transmission shaft 451*a* is extended, whereby the rear side surface portion 309*f* is moved upwardly. As a result of the above operation, the rear end portion 309*e* of the plate body 309H is pivotally lifted up about the axis of the support shaft 314. Accordingly, the pickup roller 310 which is supported on the rear end portion 309*e* side of the plate body 309H is pivotally moved upwardly. Then, the pickup roller 310 is positioned to the non-sheet feeding position (second position, see FIG. 11) where the pickup roller 310 is disposed above the uppermost sheet of the sheet stack accommodated in the sheet tray 500.

As described above, the projecting/retracting operation of the actuator 451 is converted into the vertical pivotal movement of the pickup roller 310 as a result of force transmission to the swing plate 309.

<Transport Operation of Sheet P>

The following is a description about how a sheet P accommodated in the sheet tray 500 is transported along the sheet transport path 133 in the sheet transport unit 3 in this embodiment.

Referring to FIG. 5, a sheet stack accommodated in the sheet tray 500 is placed at the sheet position P0. By the placement, the position of the sheet stack in the sheet width direction is restricted by the guide members 520. A front edge portion (second direction downstream side) of the sheet stack is lifted up by the lift plate 530. As a result of the lifting operation, as shown in FIG. 8, the front edge portion of the uppermost sheet P of the sheet stack is contacted with the pickup roller 310 which is positioned at the sheet feeding position. The controller 93 causes the first motor 91 to drive and rotate in accordance with an image forming processing of the image forming apparatus 1, and the pickup roller 310 feeds the sheet P toward the sheet feeding nip portion A. When the sheet P is fed out by the pickup roller 310, several sheets may be attempted to be fed at the same time. However, only the uppermost sheet P is allowed to pass through the sheet feeding nip portion A and is transported by the sheet feeding roller 320 which is rotated concurrently with the pickup roller 310, and the separation roller 321 which is rotated in the direction opposite to the rotating direction of the sheet feeding roller 320 in the sheet feeding nip portion A. Further, the controller 93 causes the second motor 92 to drive and rotate for rotating the transport roller 330. By the rotating operation, the sheet P that has passed through the sheet feeding nip portion A is transported further toward downstream of the sheet transport path 133, and thereafter, subjected to an image forming processing.

<Jam of Sheet P>

Figure 19:
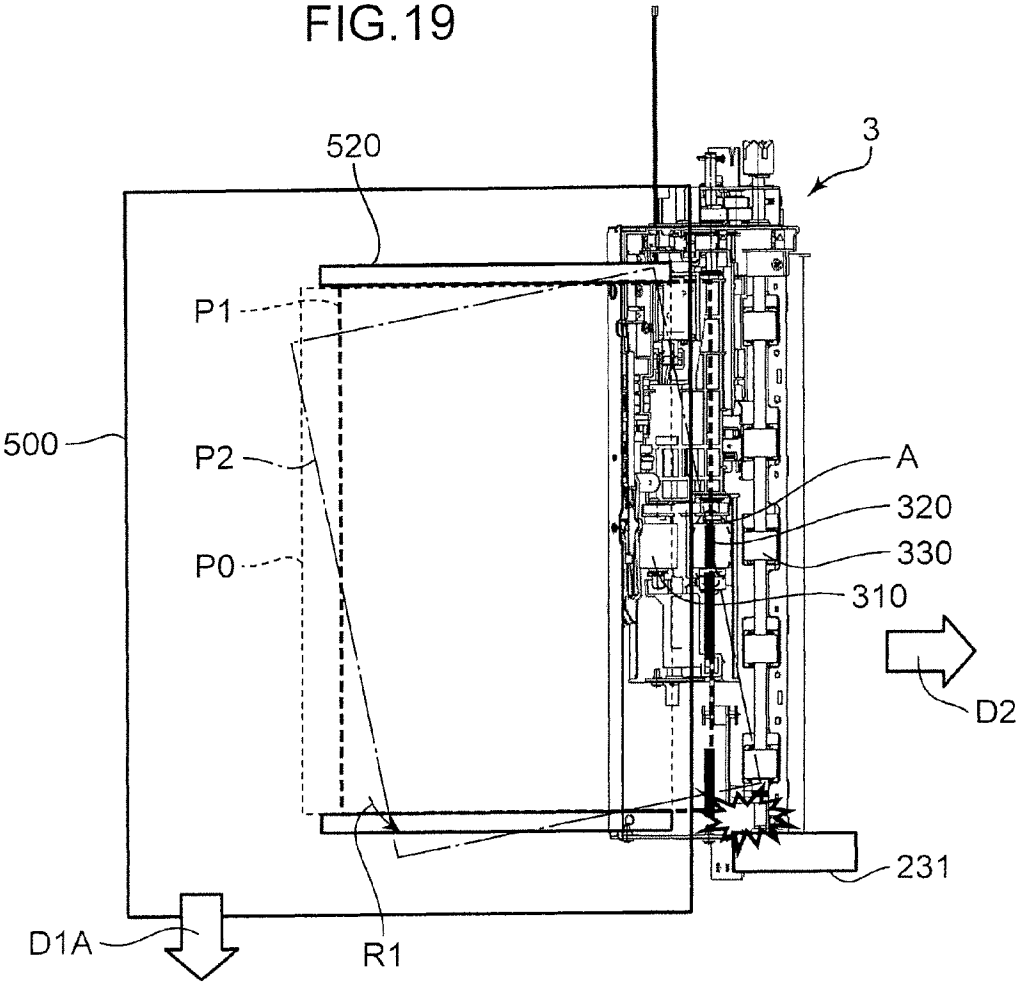
PRIOR ART FIG.19
FIG. 19 is a diagram showing a sheet jam state in a conventional sheet transport unit.

There is a case that a leading end of a sheet P fed by the pickup roller 310 may stop at a position near the sheet feeding nip portion A in the sheet transport unit 3 in a state that an image forming processing has been completed (see the sheet position P1 in FIG. 19). In particular, in this embodiment, since the film 450 is disposed at a position immediately upstream of the separation roller 321 in the sheet transport direction, the sheet P may be stopped in a state that the sheet P is stuck between a leading end of the film 450 and the sheet feeding roller 320. In the case where the user tries to pull out the sheet tray 500 in the first direction, the sheet P may be pushed in the first direction by the guide members 520, and may receive a pivotal force about or near the sheet feeding nip portion A, as indicated by the arrow R1 direction. By application of the pivotal force, the sheet P may be displaced to the sheet position P2. As the sheet tray 500 is being pulled out, a part of the sheet at the sheet position P2 may hit against the post frame 231 (see FIG. 3 and FIG. 19) of the apparatus body. As a result of the above operation, a part of the sheet P may be left in the image forming apparatus 1 while forming creases in the sheet, without being pulled out together with the sheet tray 500.

<Stopper and Function Thereof>

In order to solve the aforementioned drawback, in this embodiment, as shown in FIGS. 9 through 11, the stopper 401 is disposed to project and retract with respect to the sheet transport path 133 in the vicinity of an imaginary line Q (see FIG. 5) extending from the sheet feeding nip portion A in the first direction. In the case where a sheet feeding operation by the sheet feeding roller 320 is not performed, the stopper 401 is projected into the sheet transport path 133 for preventing transport of a sheet P toward downstream of the sheet transport path 133. In this embodiment, as shown in FIG. 9, the stopper 401 is projected downwardly through an opening 312*a* formed in the upper surface portion 312 at a position corresponding to the first direction side with respect to the sheet feeding nip portion A, and enters into an opening 304*c* formed in the second rear wall 304*b*.

In the case where transport of the sheet P is stopped in a state that a leading end of the sheet P is located near the sheet feeding nip portion A, and the stopper 401 is projected to the aforementioned position, the stopper 401 faces the front edge portion of the sheet P (see the region B in FIG. 5). When the user pulls out the sheet tray 500 in the first direction in the above state, the sheet P is pushed in the first direction along the guide members 520. When the sheet is pushed as described above, the sheet P may be applied with a force acting in the arrow R1 direction, and the sheet P is attempted to be pivotally displaced about the sheet feeding nip portion A, due to a nipping force acting near the sheet feeding nip portion A. However, since the stopper 401 restricts the front edge portion of the sheet P in the region B, the sheet P is pulled out together with the sheet tray 500 in the first direction without pivotal displacement of the sheet P (see the sheet position P2 in FIG. 5). Thus, it is possible to prevent a likelihood that a part of the sheet P may be left in the image forming apparatus 1, while forming creases in the sheet P.

Further, in the embodiment, the projecting/retracting operation of the stopper 401 is performed in association with the vertical pivotal movement of the pickup roller 310 as described above. Accordingly, the stopper 401 is allowed to project and retract with respect to the sheet transport path 133, without the need of providing a driving mechanism exclusively used for a projecting/retracting operation of the stopper 401. In the following, the projecting/retracting operation of the stopper 401 in this embodiment is described in detail.

As shown in FIG. 7, the stopper 401 is disposed on a first support holder 402 (first interlock mechanism) which is disposed on the opposite side of the swing plate 309 with respect to the pickup roller 310. The first support holder 402 has a holder main body 402*a*, a first shaft portion 404 (first pivot point portion), a first arm 402*b* (first piece) and a second arm 402*c* (second piece).

The holder main body 402*a* has a box-like shape, with one side thereof extending in the first direction. The first shaft portion 404 extends in parallel to the rotary shaft 310*a* of the pickup roller 310 from an end of the holder main body 402*a* corresponding to first direction side. The first shaft portion 404 is passed through a pivot portion 405 formed on the upper surface portion 312 of the sheet transport unit 3. The first shaft portion 404 is supported by the pivot portion 405, whereby the first support holder 402 is rotatable about an axis of the first shaft portion 404.

The first arm 402*b* and the second arm 402*c* are projecting pieces extending in opposite directions to each other from the holder main body 402*a* in a plane perpendicularly intersecting with the first shaft portion 404. An upwardly opening U-shaped engagement groove 403 (first pressure receiving portion) is formed in a distal end of the first arm 402*b*. The rotary shaft 310*a* projecting from an end surface of the pickup roller 310 in the first direction is disposed to face the engagement groove 403. Further, the plate-shaped stopper 401 extends downwardly from a distal end of the second arm 402*c*.

As described above, in the case where an electric current is not supplied to the actuator 451, the centroid of the swing plate 309 is located on the rear end portion 309*e* side. Accordingly, the pickup roller 310 is disposed at the lower position i.e. positioned to the sheet feeding position. When the pickup roller 310 is positioned to the sheet feeding position, the rotary shaft 310*a* of the pickup roller 310 presses down a U-shaped bottom of the engagement groove 403 of the first support holder 402. As a result of the pressing operation, the first support holder 402 is pivotally moved about an axis of the pivot portion 405 in such a manner that the first arm 402*b* having the engagement groove 403 is pivotally moved downwardly and that the second arm 402*c* having the stopper 401 is pivotally moved upwardly. Accordingly, the stopper 401 is moved to a position (retracted position) above the upper surface portion 312 of the sheet transport unit 3, without being projected into the sheet transport path 133.

On the other hand, in the case where an electric current is supplied to the actuator 451, the pickup roller 310 is pivotally moved to the non-sheet feeding position, which is an upper position with respect to the sheet feeding position. When the pickup roller 310 is pivotally moved to the non-sheet feeding position, since the rotary shaft 310*a* of the pickup roller 310 is disposed above the engagement groove 403 of the first support holder 402, an external force is not exerted on the first support holder 402. In this example, the centroid of the first support holder 402 is set in advance in such a manner that, in the case where an external force is not exerted on the first support holder 402, and the first support holder 402 is supported only by the pivot portion 405, the first arm 402 having the engagement groove 403 is located at an upper position, and the second arm 402*c* having the stopper 401 is located at a lower position. As a result of the above operation, the stopper 401 is moved to a position (projected position) below the upper surface portion 312 of the sheet transport unit 3, and is projected into a part of the sheet transport path 133.

As described above, in this embodiment, the projecting/retracting operation of the stopper 401 with respect to the sheet transport path 133 is performed in association with the vertical pivotal movement of the pickup roller 310 by the actuator 451 and the swing plate 309. As a result of the above operation, the stopper 401 is allowed to project and retract with respect to the sheet transport path 133, without the need of providing a driving mechanism exclusively used for projecting and retracting the stopper 401. Further, since the stopper 401 is retracted from the sheet transport path 133 and moved to a position above the upper surface portion 312 in association with a pivotal movement of the pickup roller 310 from the non-sheet feeding position to the sheet feeding position, there is no likelihood that the stopper 401 may be erroneously projected into the sheet transport path when the pickup roller 310 feeds the sheet P.

There is a case that a long-time supply of an electric current to the actuator 451 may cause temperature rise of the actuator 451. In view of the above, preferably, the controller 93 may cut off the power supply after electric current supply to the actuator 451 is continued for a predetermined time after an image forming operation of the image forming apparatus 1 is finished. With this configuration, it is possible to continue electric current supply to the actuator 451 in a time zone when the user is likely to pull out the sheet tray 500, thereby causing the stopper 401 to project into the sheet transport path 133. Further, the above configuration prevents an increase in electric power consumption or temperature rise of the actuator 451 resulting from a long-time supply of an electric current to the actuator 451.

Figure 12:
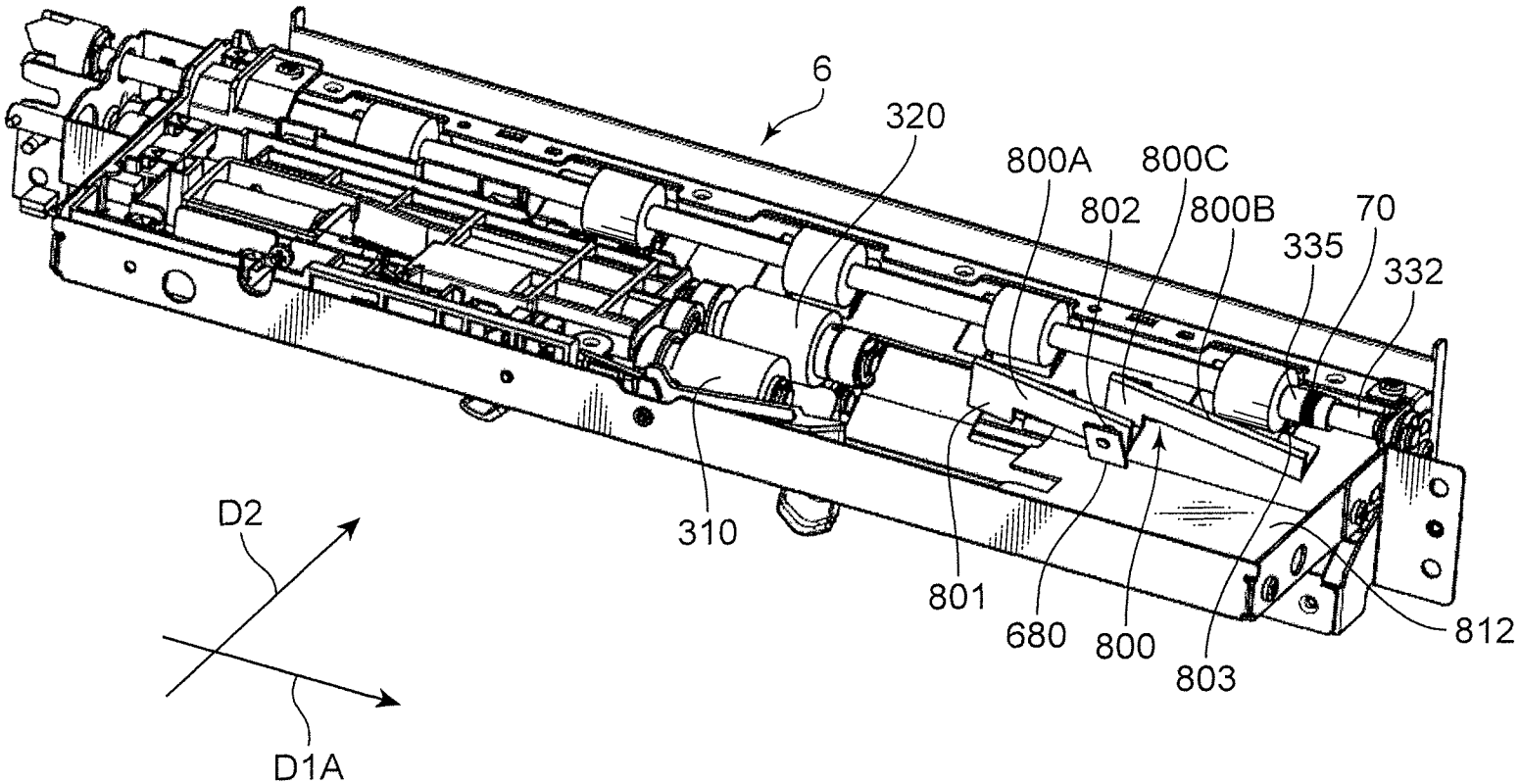
FIG. 12 is a perspective view of a sheet transport unit in a second embodiment of the present disclosure.
Figure 13:
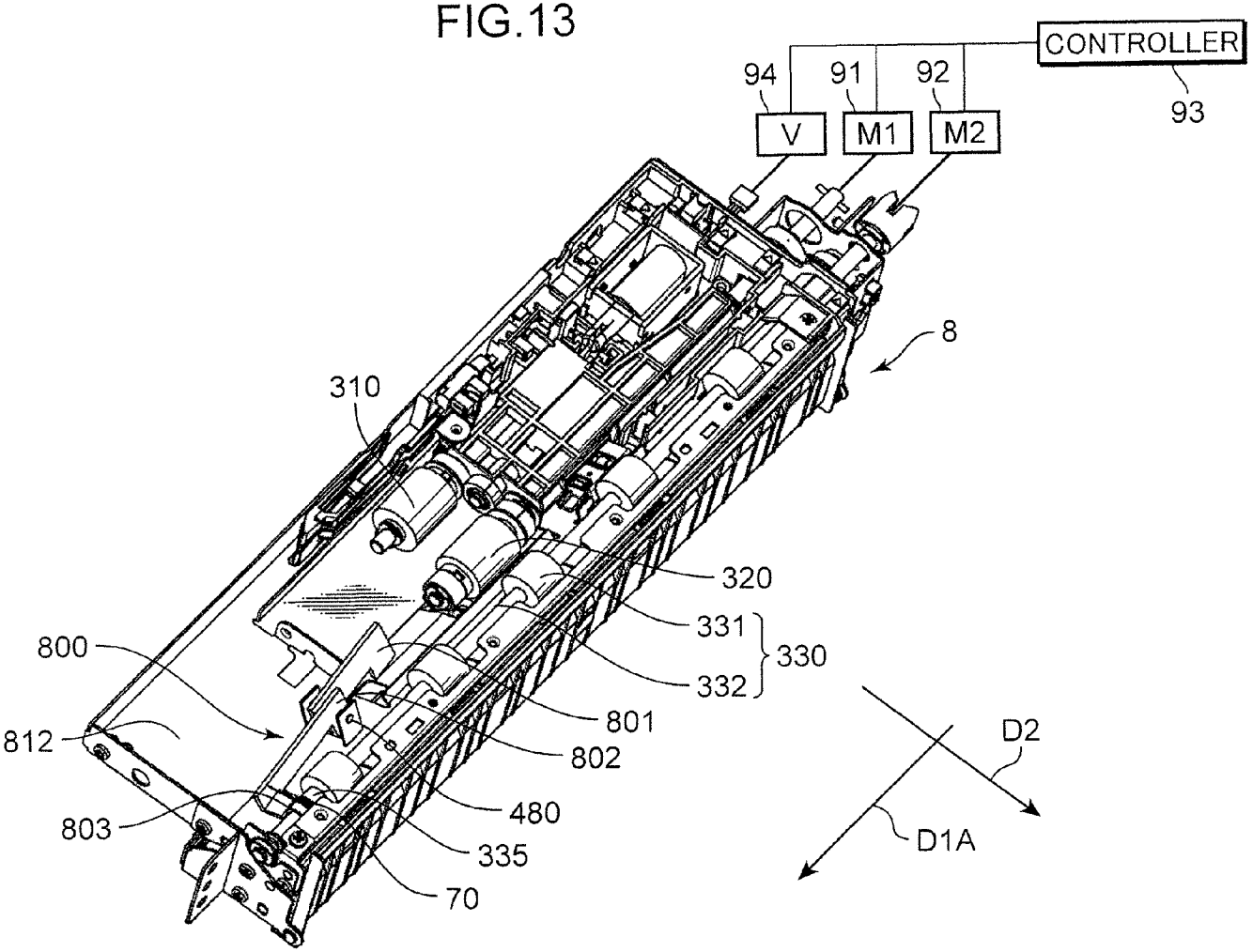
FIG. 13 is a perspective view of the sheet transport unit in the second embodiment of the present disclosure.
Figure 14:
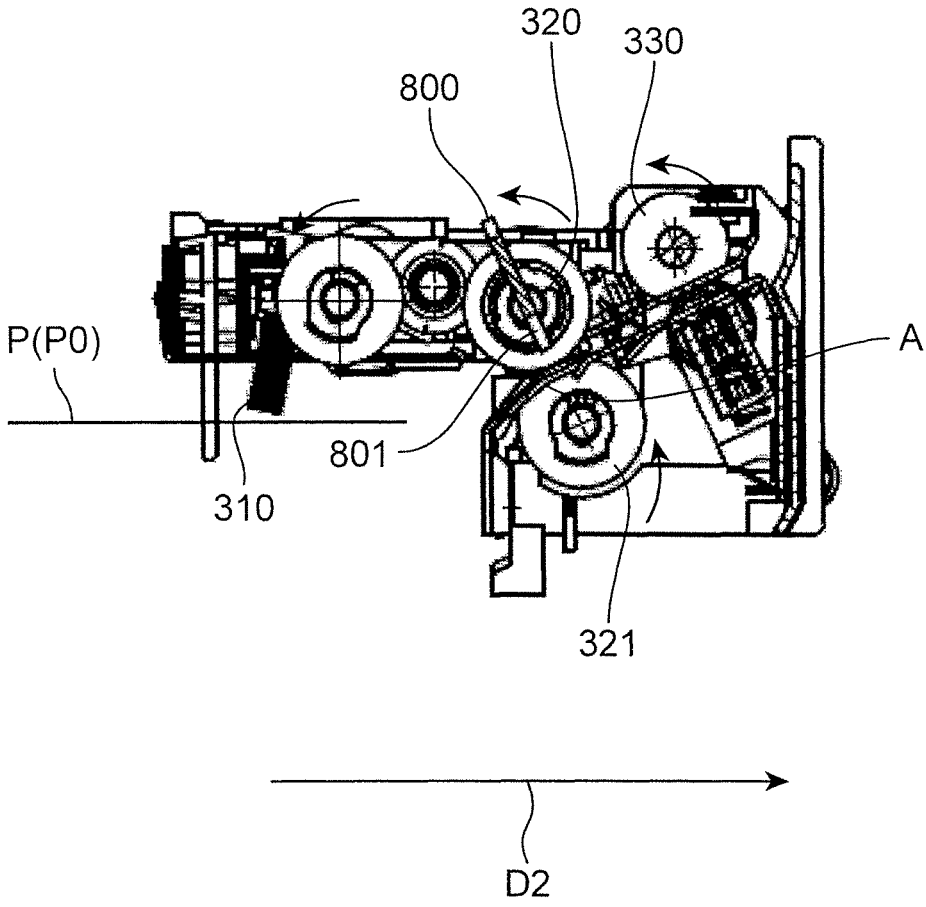
FIG. 14 is a cross-sectional view of the sheet transport unit in the second embodiment of the present disclosure.
Figure 15:
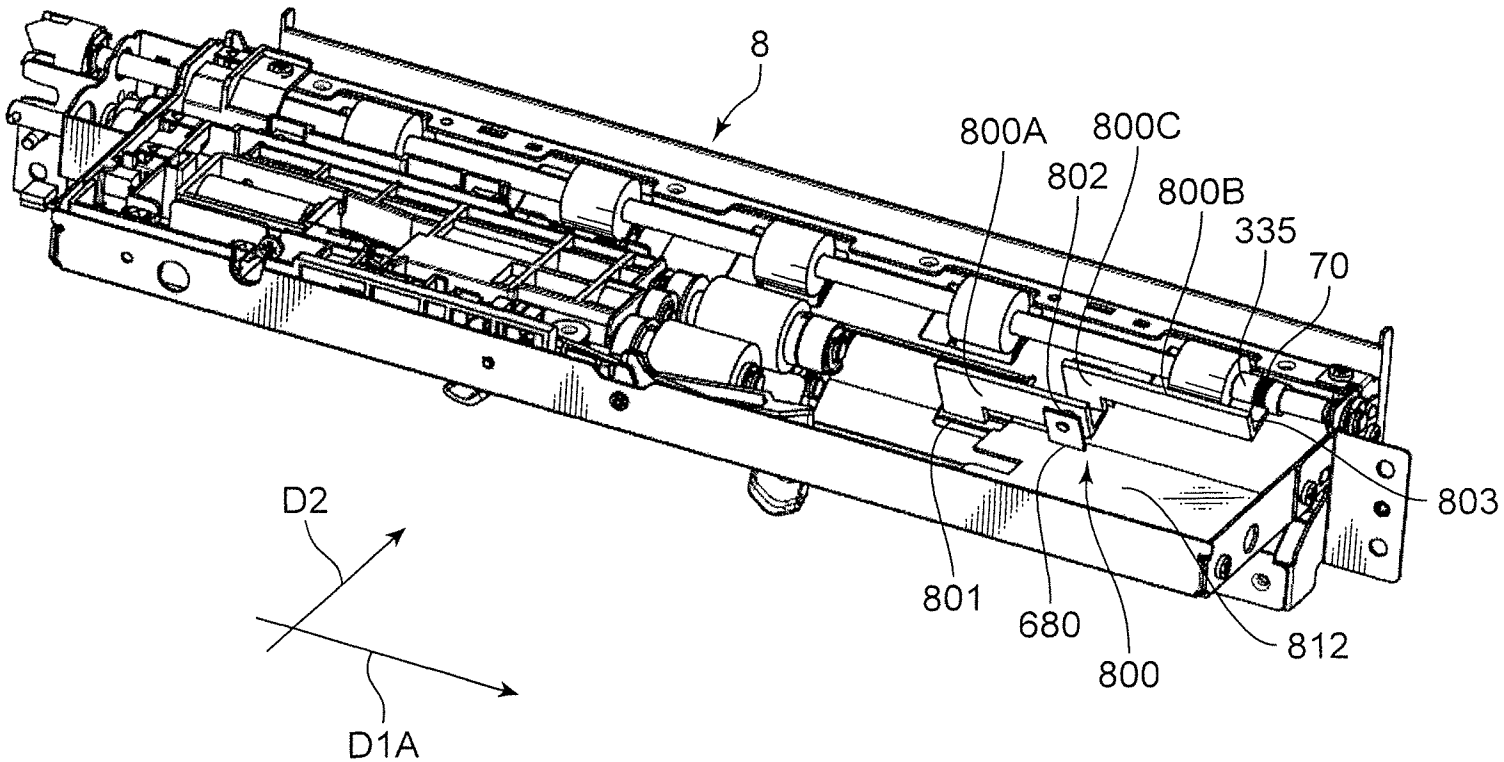
FIG. 15 is a perspective view of the sheet transport unit in the second embodiment of the present disclosure.
Figure 16:
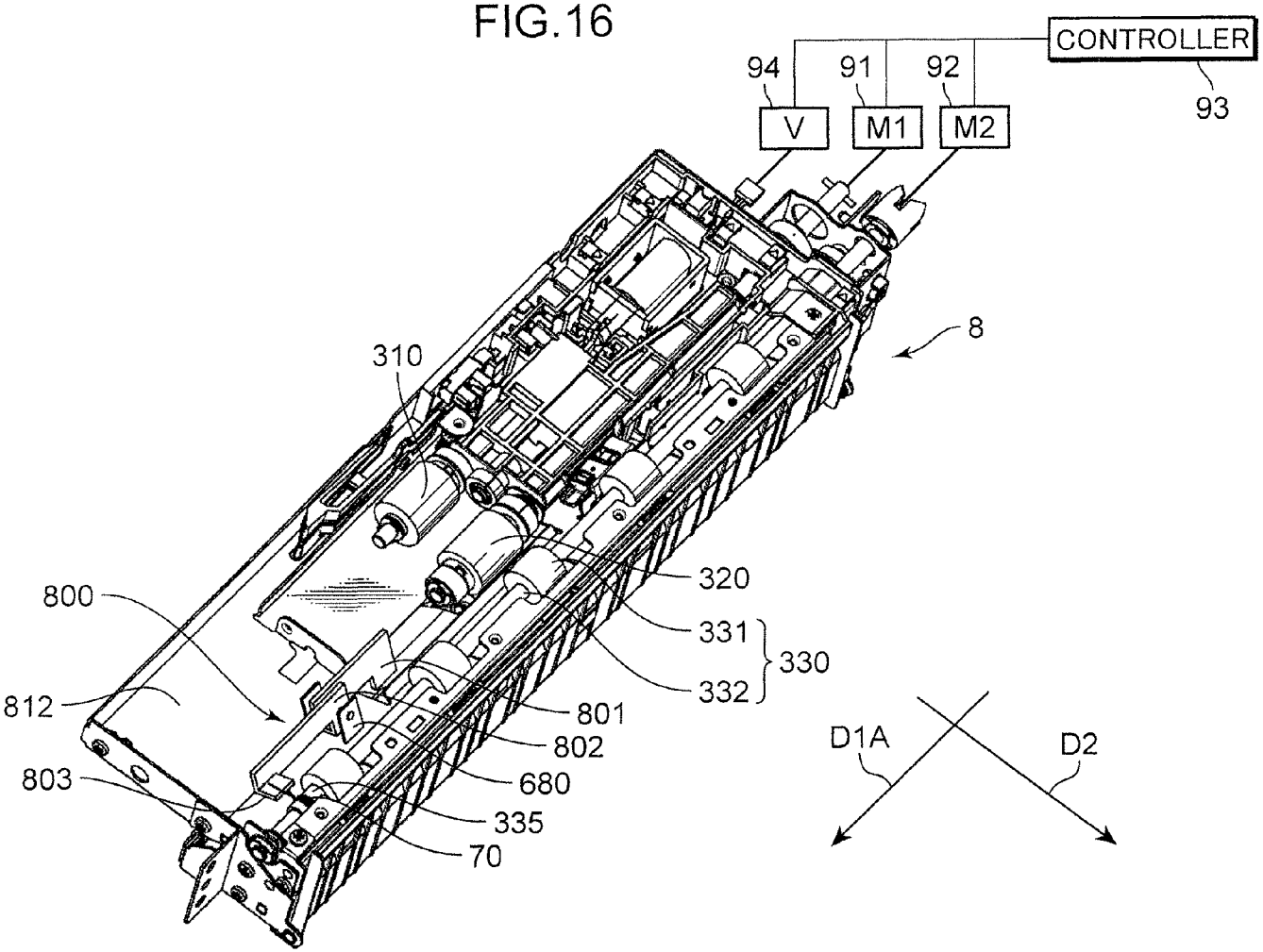
FIG. 16 is a perspective view of the sheet transport unit in the second embodiment of the present disclosure.
Figure 17:
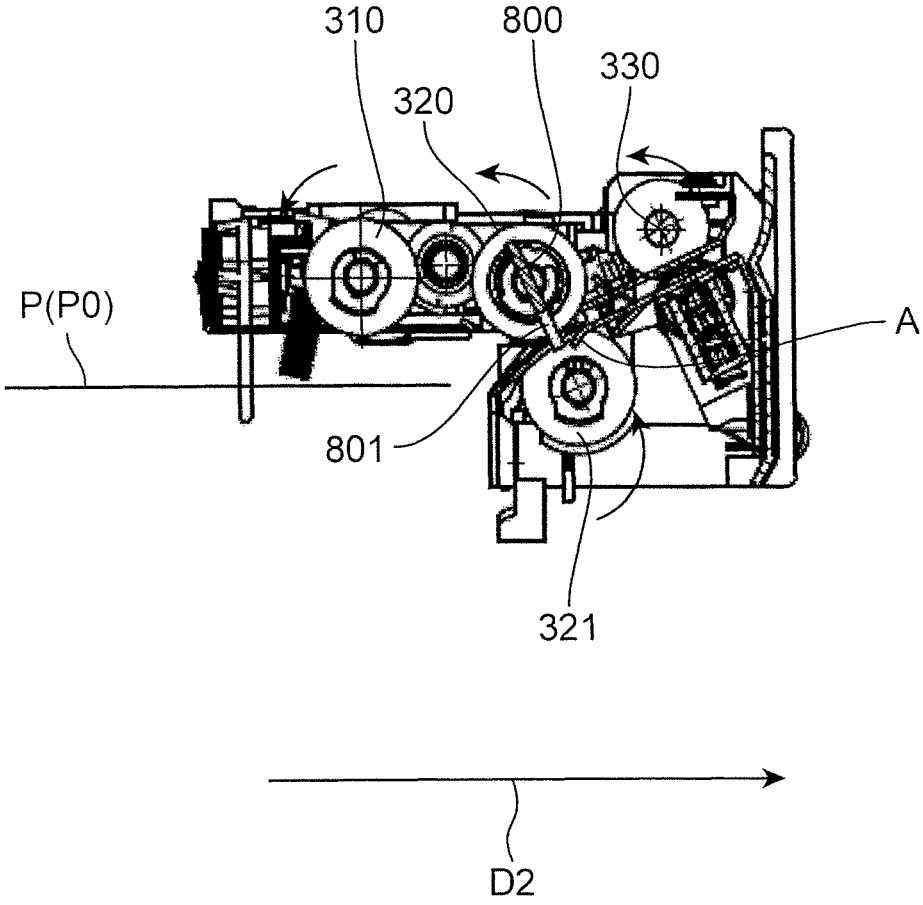
FIG. 17 is a cross-sectional view of the sheet transport unit in the second embodiment of the present disclosure.

In the following, a sheet transport unit 8 in the second embodiment of the present disclosure is described referring to FIGS. 12 through 18. FIG. 12 and FIG. 13 are perspective views of the sheet transport unit 8, and FIG. 14 is a cross-sectional view of the sheet transport unit 8. FIGS. 12 through 14 show that a stopper 801 to be described later is retracted from a sheet transport path 133. Likewise, FIG. 15 and FIG. 16 are perspective views of the sheet transport unit 8, and FIG. 17 is a cross-sectional view of the sheet transport unit 8. FIGS. 15 through 17 show that the stopper 801 to be described later is projected into the sheet transport path 133.

The second embodiment is different from the first embodiment in the arrangement position of the stopper 801 which is projected and retracted with respect to the sheet transport path 133, and a driving mechanism for causing the stopper 801 to perform a projecting/retracting operation. Since the arrangement of the second embodiment other than the above is substantially the same as the arrangement of the first embodiment, description of the arrangement of the second embodiment is omitted herein.

In this embodiment, as shown in FIG. 12, the stopper 801 projecting into the sheet transport path 133 is disposed on a second support holder 800 (second interlock mechanism) which is disposed in parallel to a transport roller 330 on an upper surface portion 812 of the sheet transport unit 8. The second support holder 800 has a first plate 800A (fourth piece), a second plate 800B (third piece), and a middle portion 800C.

The middle portion 800C has a U-shape in section, and interconnects the first plate 800A and the second plate 800B at a middle portion of each of the first plate 800A and the second plate 800B in the first direction. A support shaft 802 (second pivot point portion) is disposed on the middle portion 800C. The support shaft 802 is passed through a support portion 680 projecting from the upper surface portion 812 to be pivotally movable.

The first plate 800A is a plate-like member which extends in the counter first direction (in the direction opposite to the arrow D1A direction in FIG. 12) from the middle portion 800C. The plate-shaped stopper 801 (projecting member) extends downwardly from a distal end of the first plate 800A.

The second plate 800B is a plate-like member extending in the first direction from the middle portion 800C. An effort point portion 803 (second pressure receiving portion) is disposed at a distal end of the second plate 800B.

A driving force for pivotally moving the second support holder 800 about an axis of the support shaft 802 is transmitted to the effort point portion 803. The effort point portion 803 has a T-shape in section and projects from the distal end of the second plate 800B. The projecting direction of the effort point portion 803 is configured to extend toward a roller shaft 332 of the transport roller 330 which is disposed on the upper surface portion 812 (see FIG. 18).

Figure 18:
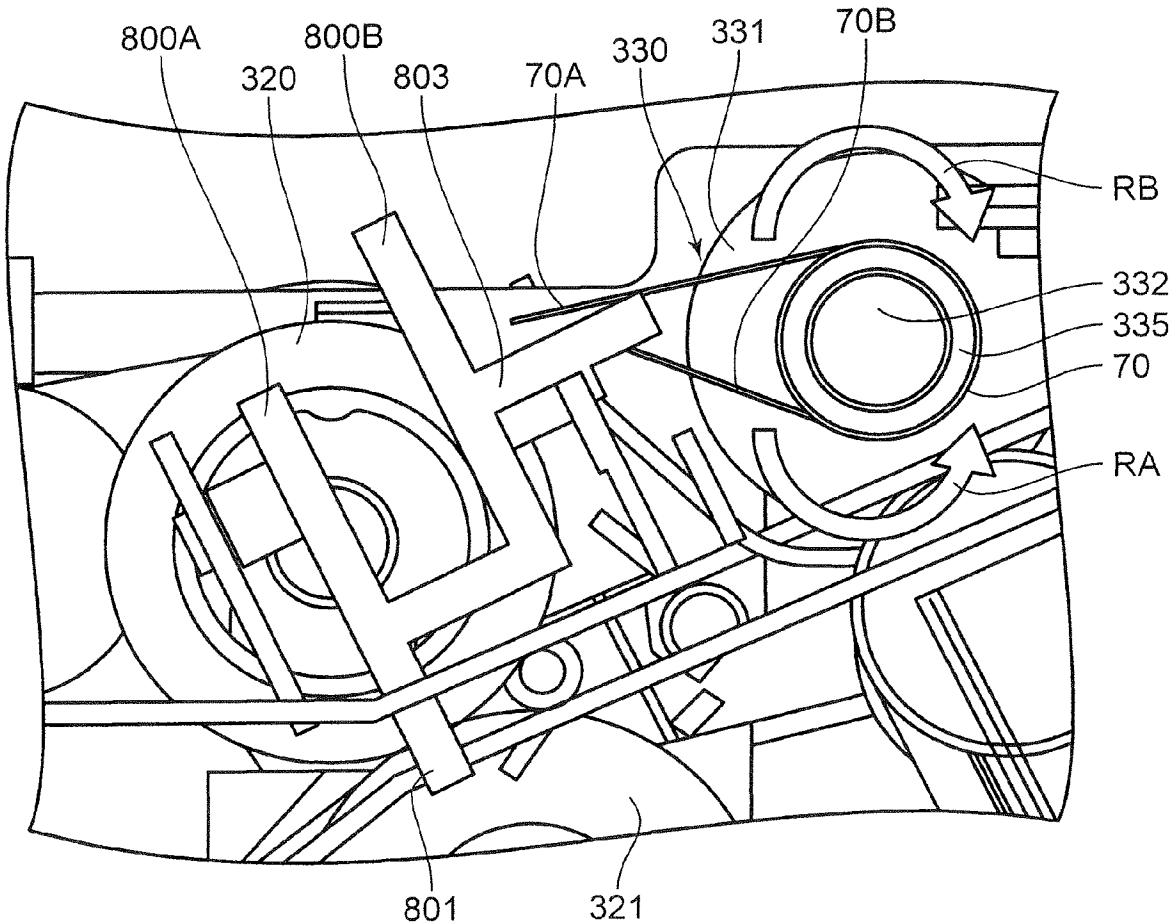
FIG. 18 is a cross-sectional view of a second support holder in the sheet transport unit in the second embodiment of the present disclosure.

Referring to FIG. 18, the transport roller 330 has a sleeve 335 in the form of a pipe at a position facing the effort point portion 803 of the roller shaft 332. Further, a coil portion of a torsion spring 70 is mounted on the circumferential surface of the sleeve 335. Two shaft end portions 70A and 70B projecting from the torsion spring 70 are contacted with the effort point portion 803 in such a manner that the effort point portion 803 of the second support holder 800 is vertically sandwiched between the shaft end portions 70A and 70B.

In this embodiment, a projecting/retracting operation of the stopper 801 is performed in association with a rotation driving operation of the transport roller 330. A second motor 92 is controlled to be rotated in forward and backward directions by a controller 93.

As shown by the arrow RA in FIG. 18, in the case where the transport roller 330 is driven in a forward direction for transporting a sheet, the shaft end portion 70A of the torsion spring 70 presses the effort point portion 803 downwardly. As a result of the pressing operation, the second support holder 800 is pivotally moved about the axis of the support shaft 802, and the stopper 801 on the first plate 800A side is moved upwardly. Specifically, in the case where the transport roller 330 is driven and rotated in the forward direction, the stopper 801 is not projected into the sheet transport path 133, and is disposed at a retracted position (see FIGS. 12 through 14).

On the other hand, as shown by the arrow RB in FIG. 18, in the case where the transport roller 330 is driven in the backward direction, the shaft end portion 70B of the torsion spring 70 presses the effort point portion 803 upwardly. As a result of the pressing operation, the second support holder 800 is pivotally moved about the axis of the support shaft 802, and the stopper 801 on the first plate 800A side is moved downwardly. Specifically, in the case where the transport roller 330 is driven and rotated in the backward direction, the stopper 801 is projected into the sheet transport path 133, and provides an effect of restricting a front edge portion of a sheet P substantially in the same manner as the stopper 401 in the first embodiment (see FIGS. 15 through 17).

Adjusting in advance a resilient force of the shaft end portions 70A and 70B of the torsion spring 70 and a downward pressing force exerted on the effort point portion 803 by the weight of the second support holder 800 allows the stopper 801 to project into the sheet transport path 133, even in a state that rotation of the transport roller 330 is stopped.

As described above, in this embodiment, a projecting/retracting operation of the stopper 801 with respect to the sheet transport path 133 is switched in association with a rotation driving operation of the transport roller 330. Thus, there is no need of providing a dedicated driving mechanism for performing a projecting/retracting operation of the stopper 801, and an existing driving mechanism is allowed to perform the projecting/retracting operation of the stopper 801. Further, a pressing force is exerted on the effort point portion 803 in directions different from each other depending on the rotating directions of the transport roller 330. When the effort point portion 803 is pressed, since the stopper 801 is retracted from the sheet transport path 133 and moved to a position above the upper surface portion 312, there is no likelihood that the stopper 801 may be erroneously projected into the sheet transport path 133 when the transport roller 330 feeds a sheet.

In the foregoing embodiments, even in the case where the sheet tray 500 is pulled out in the first direction in a state that a leading end of a sheet P fed out of the sheet tray 500 is about to be fed into the sheet transport path 133 extending in the second direction, it is possible to prevent a likelihood that the sheet P may be stuck between the sheet tray 500 and the lower housing portion 21, and a part of the sheet P may be left in the lower housing portion 21. Thus, it is possible to prevent damage of the sheet P and to smoothly perform an operation of pulling out the sheet tray 500 in the first direction.

The present disclosure is not limited to the foregoing embodiments, but may adopt the following modifications.

(1) The embodiments are configured to project and retract the stopper 401, 801 in association with a vertical pivotal movement of the pickup roller 310 and in association with a rotation driving operation of the transport roller 330. The driving mechanism for projecting or retracting a stopper is not limited to the above. For instance, it is possible to provide a dedicated actuator or a dedicated motor for performing a projecting/retracting operation of a stopper.

(2) Further alternatively, a stopper may be configured to be projected and retracted with respect to the sheet transport path 133 in association with a user's operation of pulling out the sheet tray 500. Specifically, it is possible to provide in advance a wire extending from the sheet tray 500 to the lower housing portion 21 of the apparatus body. In the modification, when the user starts to pull out the sheet tray 500, a tension force is exerted on the wire, and the stopper is projected into the sheet transport path 133 by the tension force via a predetermined driving mechanism.

Figure 20A:
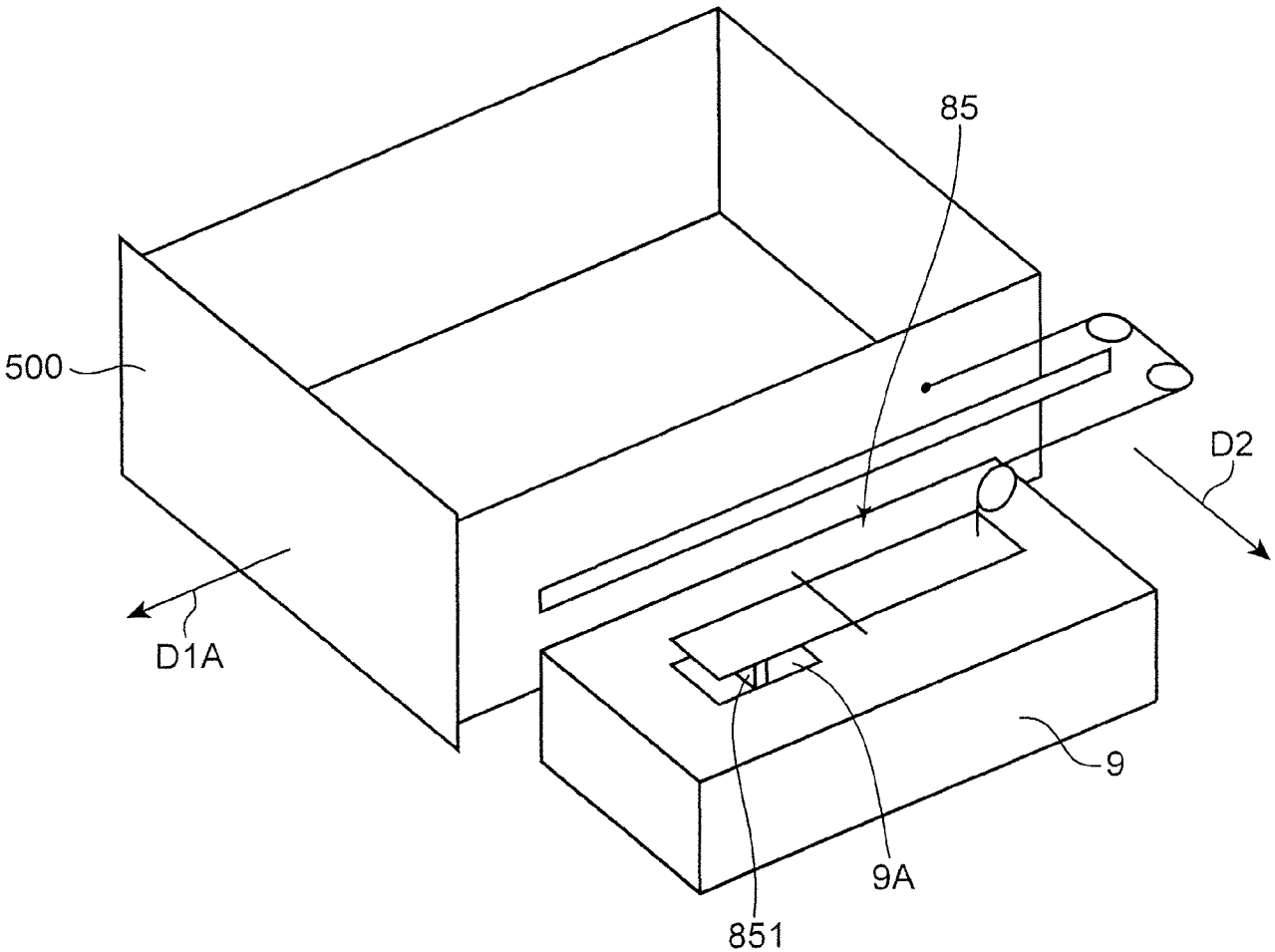
FIG. 20A is a perspective view of a third support holder in a sheet transport unit in a modification of the embodiment of the present disclosure.
Figure 20B:
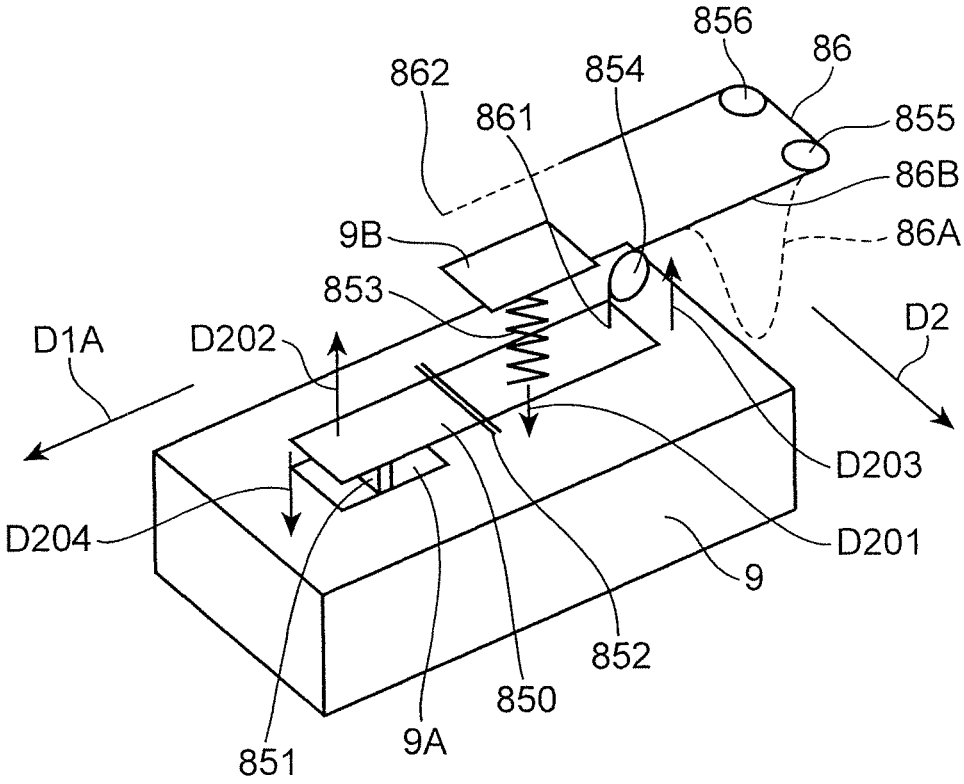
FIG. 20B is an enlarged perspective view of the third support holder in the sheet transport unit in the modification of the embodiment of the present disclosure.

The modification described in the section (2) is described referring to FIGS. 20A and 20B. FIGS. 20A and 20B are perspective views of an interlock portion 85 in the modification. FIG. 20A is a perspective view of a sheet tray 500 and a sheet transport unit 9, and FIG. 20B is an enlarged perspective view of the sheet transport unit 9.

Referring to FIG. 20A, the sheet transport unit 9 is disposed at second direction downstream side of the sheet tray 500. Similarly to the sheet transport units 3 and 8 in the first and second embodiments, various transport rollers are provided in the sheet transport unit 9. A stopper 851 is configured to be projected and retracted with respect to a sheet transport path 133 through an opening 9A formed in the sheet transport unit 9. The interlock portion 85 (third interlock mechanism) is configured to project and retract the stopper 851 in association with a user's operation of pulling out the sheet tray 500.

The interlock portion 85 is constituted of a third support holder 850, pulleys 854, 855 and 856, and a wire 86. The third support holder 850 is rotatable about an axis of a rotary shaft 852. The stopper 851 is projected downwardly from one end of the third support holder 850. Further, an end 861 of the wire 86 is fixed to the other end (the side opposite to the stopper 851 with respect to the rotary shaft 852) of the third support holder 850. Further, a lower end of a spring 853 is disposed between the rotary shaft 852 of the third support holder 850 and a fixing portion of the wire 86. An upper end of the spring 853 is contacted with a wall portion 9B of the image forming apparatus which is located above the third support holder 850. The third support holder 850 is urged downwardly by the spring 853 in the arrow D201 direction. The wire 86 is wound around the pulleys 854, 855, and 856. The other end 862 of the wire 86 is fixed to the sheet tray 500.

In the case where the sheet tray 500 is placed in a lower housing portion 21, the wire 86 is flexed between the pulleys 854 and 855 (see a wire state 86A). Further, a portion of the third support holder 850 corresponding to the first direction upstream side is urged downwardly by the spring 85 as described above. Accordingly, a portion of the third support holder 850 corresponding to the first direction downstream side is pivotally moved upwardly about an axis of the rotary shaft 852 in the arrow D202 direction. As a result of the pivotal movement, the stopper 851 is retracted to a position above the opening 9A.

On the other hand, when the sheet tray 500 is pulled out of the lower housing portion 21, the wire 86 is pulled by the sheet tray 500 (see a wire state 86B). As a result of the pulling operation, an end of the third support holder 850 corresponding to the first direction upstream side is lifted up in the arrow D203 direction, as the spring 853 is compressed. As a result of the lifting operation, the portion of the third support holder 850 corresponding to the first direction downstream side is pivotally moved downwardly about the axis of the rotary shaft 852 in the arrow D204 direction. As a result of the pivotal movement, the stopper 851 is projected downwardly into the sheet transport path 133 through the opening 9A.

(3) Further, in the foregoing embodiments, the sheet transport path 133 is used as a sheet transport path along which a sheet is fed to the image forming assembly 903. Alternatively, a sheet transport device may be provided with a sheet transport path along which a sheet is transported to an element for cutting a sheet, an element for folding a sheet, an element for forming a hole in a sheet, or an element for applying an intended processing to a sheet.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A sheet transport device, comprising:

a housing member;

a sheet tray in which a number of sheets are accommodated, the sheet tray being detachably attached to the housing member and configured to be pulled out of the housing member in a first direction;

a sheet transport path formed in the housing member and extending from the sheet tray in a second direction that intersects the first direction;

a sheet dispensing portion disposed to face the sheets accommodated in the sheet tray, and to dispense the sheets to the sheet transport path;

a sheet feeding portion that is rotated in contact with the sheet dispensed from the sheet dispensing portion, and feeds the sheet toward downstream of the sheet transport path;

a sheet separating portion facing the sheet feeding portion, and separating the sheet to be fed from the other sheets; and a projecting member configured to be projected and retracted with respect to the sheet transport path at a downstream position in the second direction away from a leading end of a sheet accommodated in the sheet tray, near an imaginary line extending from a sheet nip portion in the first direction and at a distance from the sheet nip portion in the first direction, the sheet nip portion being formed by the sheet feeding portion and the sheet separating portion.

2. The sheet transport device according to claim 1, further comprising:

a moving portion which moves the sheet dispensing portion between a first position where the sheet dispensing portion is contacted with the sheet, and a second position where the sheet dispensing portion is disposed away from the sheet, wherein the projecting member is projected into the sheet transport path in association with a movement of the sheet dispensing portion from the first position to the second position by the moving portion.

3. The sheet transport device according to claim 2, further comprising:

a controller which controls supply of an electric current to the moving portion, wherein the moving portion includes an electric actuator which outputs a driving force for moving the sheet dispensing portion, the moving portion being configured to move the sheet dispensing portion from the first position to the second position, as the electric current is supplied by the control of the controller.

4. The sheet transport device according to claim 3, wherein the controller is configured to stop electric current supply after the electric current supply to the actuator is continued for a predetermined time, after a sheet feeding operation by the sheet feeding portion is finished.

5. An image forming apparatus, comprising:

a sheet transport device according to claim 4; and an image forming assembly that forms an image on the sheet.

6. An image forming apparatus, comprising:

a sheet transport device according to claim 3; and an image forming assembly that forms an image on the sheet.

7. An image forming apparatus, comprising:

a sheet transport device according to claim 2; and an image forming assembly that forms an image on the sheet.

8. The sheet transport device according to claim 1, wherein the projecting member is secured to be projected and retracted with respect to the sheet transport path on the imaginary line.

9. An image forming apparatus, comprising:

a sheet transport device according to claim 8; and an image forming assembly that forms an image on the sheet.

10. The sheet transport device according to claim 1, wherein the projecting member projecting to the sheet transport path is disposed opposite to the leading end of the sheet that has been dispensed by the sheet dispensing portion and stopped near the imaginary line.

11. An image forming apparatus, comprising:

a sheet transport device according to claim 10; and an image forming assembly that forms an image on the sheet.

12. An image forming apparatus, comprising:

a sheet transport device according to claim 1; and an image forming assembly that forms an image on the sheet.

13. A sheet transport device, comprising:

a housing member;

a sheet tray in which a number of sheets are accommodated, the sheet tray being detachably attached to the housing member and configured to be pulled out of the housing member in a first direction;

a sheet transport path formed in the housing member and extending from the sheet tray in a second direction that intersects the first direction;

a sheet dispensing portion disposed to face the sheets accommodated in the sheet tray and to dispense the sheets to the sheet transport path;

a sheet feeding portion that is rotated in contact with the sheet dispensed from the sheet dispensing portion, and feeds the sheet toward downstream of the sheet transport path;

a sheet separating portion disposed facing the sheet feeding portion and separating the sheet to be fed from the other sheets;

a moving portion that moves the sheet dispensing portion between a first position where the sheet dispensing portion is contacted with the sheet, and a second position where the sheet dispensing portion is disposed away from the sheet;

a projecting member configured to be projected and retracted with respect to the sheet transport path at a position near an imaginary line extending from a sheet nip portion in the first direction and at a distance from the sheet nip portion in the first direction, the sheet nip portion being formed by the sheet feeding portion and the sheet separating portion, the projecting member being projected into the sheet transport path in association with a movement of the sheet dispensing portion from the first position to the second position by the moving portion; and an interlock mechanism that causes the projecting member to project and retract in association with the movement of the sheet dispensing portion by the moving portion, the interlock mechanism including:

a pivot point portion;

a first piece and a second piece extending from the pivot point portion in directions opposite to each other; and a first pressure receiving portion formed at a side of a distal end of the first piece, and pressed by the sheet dispensing portion when the sheet dispensing portion is moved from the second position to the first position, wherein the projecting member is disposed at a side of a distal end of the second piece.

14. An image forming apparatus, comprising:

a sheet transport device according to claim 13; and an image forming assembly that forms an image on the sheet.

15. A sheet transport device, comprising:

a housing member;

a sheet tray in which a number of sheets are accommodated, the sheet tray being detachably attached to the housing member and configured to be pulled out of the housing member in a first direction;

a sheet transport path formed in the housing member and extending from the sheet tray in a second direction that intersects the first direction;

a sheet dispensing portion disposed to face the sheets accommodated in the sheet tray and to dispense the sheets to the sheet transport path;

a sheet feeding portion that is rotated in contact with the sheet dispensed from the sheet dispensing portion, and feeds the sheet toward downstream of the sheet transport path;

a sheet separating portion disposed facing the sheet feeding portion and separating the sheet to be fed from the other sheets;

a transport roller that is rotated in a first rotating direction and transports the sheet fed from the sheet feeding portion toward downstream in a sheet transport direction;

a rotary shaft supporting the transport roller rotatably; and a rotation driving portion that rotates the transport roller in the first rotating direction and in a second rotating direction opposite to the first rotating direction;

a projecting member configured to be projected and retracted with respect to the sheet transport path at a position near an imaginary line extending from a sheet nip portion in the first direction and at a distance from the sheet nip portion in the first direction, the sheet nip portion being formed by the sheet feeding portion and the sheet separating portion, the projecting member being projected into the sheet transport path in association with an operation of stopping rotation of the transport roller, or in association with an operation of rotating the transport roller in the second rotating direction;

an interlock mechanism that causes the projecting member to project and retract with respect to the sheet transport path in association with the operation of rotating the transport roller, the interlock mechanism including:

a pivot point portion, a first piece and a second piece extending from the pivot point portion in directions opposite to each other, the projecting member being disposed at a side of a distal end of the second piece, and a pressure receiving portion disposed at a side of a distal end of the first piece; and a pressing portion attached to the rotary shaft and configured to press the pressure receiving portion of the interlock mechanism in directions different from each other depending on the rotating directions of the transport roller.

16. An image forming apparatus, comprising:

a sheet transport device according to claim 15; and an image forming assembly that forms an image on the sheet.

* * * * *